US008766151B1

(12) United States Patent
Weber

(10) Patent No.: US 8,766,151 B1
(45) Date of Patent: Jul. 1, 2014

(54) COOKING TIME INDEPENDENT FRONT-FACING TURNTABLE PARKING RETURN FOR MICROWAVE OVEN

(75) Inventor: Harold J. Weber, Centerville, MA (US)

(73) Assignee: Savvy Stuff Property Trust, Centerville, MA (US)

( * ) Notice: Subject to any disclaimer, the term of this patent is extended or adjusted under 35 U.S.C. 154(b) by 64 days.

(21) Appl. No.: 13/385,437

(22) Filed: Feb. 21, 2012

Related U.S. Application Data

(63) Continuation-in-part of application No. 11/650,774, filed on Jan. 9, 2007, now Pat. No. 8,124,920.

(51) Int. Cl.
*H05B 6/78* (2006.01)
*F24C 7/02* (2006.01)

(52) U.S. Cl.
USPC ..... 219/754; 219/708; 219/732; 99/443 R

(58) Field of Classification Search
USPC ..... 219/722, 752–755, 762, 702, 708, 719, 219/732, 518, 389; 99/325, 451, 443 R
See application file for complete search history.

(56) References Cited

U.S. PATENT DOCUMENTS

| | | | | |
|---|---|---|---|---|
| 4,939,333 | A | 7/1990 | Sakai et al. | 219/10.55 |
| 5,440,105 | A | 8/1995 | Kim | 219/754 |
| 5,558,799 | A | 9/1996 | Kang | 219/754 |
| 5,942,145 | A | 8/1999 | Jeon et al. | 219/754 |
| 6,002,119 | A | 12/1999 | Kim | 219/722 |
| 7,351,943 | B1 | 4/2008 | Kubler | 219/754 |
| 8,124,920 | B1 | 2/2012 | Weber | |

FOREIGN PATENT DOCUMENTS

JP 2001221446 A * 8/2001

OTHER PUBLICATIONS

Translation JP2001221446A of Yamamoto et al., http://dossier1.ipd1.inpit.go.jp/cgi-bin/tran_web_cgi_ejje?.*
U.S. Appl. No. 11/650,774, filed Jan. 9, 2007, Weber, Now issued as U.S. Patent No. 8,124,920 on Feb. 28, 2012.

* cited by examiner

*Primary Examiner* — Quang Van

(57) ABSTRACT

A microwave oven which accepts user-placement of a cook item on a turntable accessed through a usually front-facing door. The turntable is rotated during a preset cook-time. The turntable returns to the original user-placement situation near the door and concurrently stops at the end of the cook-time. This results in a simultaneous end of turntable rotation and an end of cooking, enabling the cook-item to be conveniently reparked adjacent with the access door thereby enabling safe and convenient removal immediately upon completion of the cook-time. The cook-time and the turntable operational and reparking parameters are factored to enable a maximum extent of turntable rotation during the cook time and still assure the return to the original starting location concurrent with cook-time completion.

17 Claims, 18 Drawing Sheets

COOKING TIME INDEPENDENT FRONT-FACING TURNTABLE PARKING RETURN FOR MICROWAVE OVEN

CROSS-REFERENCE TO RELATED APPLICATIONS

This application is a Continuation-In-Part of application Ser. No. 11/650,774 filed Jan. 9, 2007, allowed Oct. 18, 2011, now U.S. Pat. No. 8,124,920 issued Feb. 28, 2012 and subsequent to this application.

FIELD OF INVENTION

This invention generally pertains to a microwave oven having a rotating turntable to enhance uniformity of cooking food. Moreover, the invention relates to user convenience, better accessibility, and enabling a safe removal of a heated cooking-dish or a cooked food-item from the microwave oven once the cook-cycle has ended. The invention particularly discusses microwave oven access for attaining a front-facing food-item or cook-item placement and safe removal consideration, where the turntable returns and reparks the heated-item concurrent with an end of the cook-cycle, with the food-item returned to about the same physical position as where it was placed at the onset of the cook-cycle. A conveniently repeated food-item emplacement and removal location adjacent with a front access doorway is described that contributes to user convenience and safety with less chance for spillage or dropping of the food-item or cooking-dish upon being lifted from the oven.

SYNOPSIS

In this invention's operating scenario, a "to be cooked" cook-item $F_C$ is initially placed on a rotating turntable having a finite or fixed rotational speed and circumvolutory time period $TR_T$. A preferred cook-time $CK_T$ is selected for the cook-item and the selected time is divided in half, e.g., $CK_{TA}=CK_{TB}=CK_T/2$. The microwave heating of the cook-item and the rotation cycle for the turntable start concurrently. The turntable turns in a forward circumrotary direction $DR_A$ for a first half of the cook-time $CK_{TA}$. The turntable rotation cycle is completed by reversing direction when the halfway point for the cook-time is reached and the turntable is counter-rotated in an opposite circumrotary direction $DR_B$ for a second half of the cook-time $CK_{TB}$. Overall Turntable Travel (OTT) includes an angular extent $TA_{EA}$ of the initial forward turntable rotation $DR_A$ and subsequent extent $TA_{EB}$ of the turntable counter-rotation $DR_B$ are proportioned to mutually cancel one-another, e.g., $[OTT=TA_{EA}+(-TA_{EB})=\emptyset]$ and return the cook-item near its initial front-facing placement location $F_P$, allowing for safe and easy removal by the user.

In a variation of this approach, the microwave heating and the rotation cycle for the turntable start concurrently, with the turntable forward rotating for nominally one-fourth of the cook-time, e.g., $CK_{TAA}=CK_{TAC}=CK_T/4$. The turntable rotation is reversed and counter-rotated for one-half the cook-time $-CK_{TAB}=CK_T/2$, followed by another turntable reversal and a completion of the circumvolution cycle by forward rotating for a remaining nominal quarter of the cook-time $CK_{TAC}$. Overall, the concurrent microwave heating and turntable circumvolution intends that a sum of the two lesser rotation $CK_{TAA}$ and $CK_{TAC}$ times must equal one-half the cook time (e,g, $CK_{TAA}+CK_{TAC}=CK_T/2$) and thereby balance-out the contrarotation time $CK_{TAB}$ in order to achieve reparking of the cook-item near its initial front-facing location, adjacent with the microwave's access doorway with the overall turntable rotation time relative with the cook-time canceling out, e.g., $$CK_{TAA}+CK_{TAC}+(-CK_{TAB})=\emptyset.$$

Submitting additional time to a cook schedule for a cook-item once the microwave cooking has started is accomplished by adding the extra time to the original cook-time $CK_T$ value. The duration of the overall turntable rotation cycle is modified by adding one-half of the additional time to the forward rotation and the consummate half to the contrarotation time of the turntable. In event the turntable is already counter-rotating, one half the submitted extra time is instead added to the contrarotation time to lengthen its overall duration while the consummate half of the extra time urges a supplementary forward drive of the turntable subsequent to the contrarotation. In other words, the forward rotation time and the contrarotation time mutually cancel one-another to maintain the return and reparking of the cook-item adjacent with the access portal at the end of the modified cook-time.

The forward or initial circumrotary direction $DR_A$ of turntable rotation may be further fragmented into lesser turning-events $DR_{A1}$, $DR_{A2}$ [e.g., $DR_A=DR_{A1}+DR_{A2}$]. As long as a sum-total of the OTT for the several forward rotation events $DR_{A1}+DR_{A2}$ and the contrarotation direction $DR_B$ event are of about equal overall duration and angular extent $[TA_{EA}=TA_{EB}]$, they will mutually cancel one-another, e.g., $OTT=DR_A-DR_B=\emptyset$. The desired result is attained by delivering a return of the cook-item to its original initial placement location $F_P$.

An early interruption of the cook-time $CK_{INT}$ usually results in the location of the cook-item being randomly stopped instead of being reparked at it's preferred original initial placement location $F_P$. As this invention reveals, the early interruption of the cook-time $CK_{INT}$ may further redetermine a continued turntable rotation or contrarotation to occur in a direction that will most quickly return and repark the cook-item in the original initial front-facing placement location $F_P$, albeit cooking is already stopped.

In a similar way, any extension of the cook-time $CK_{EXT}$ conventionally causes the turn-table to circumrotate past its initially scheduled stopping point. This invention shows that the extended cook-time $CK_{EXT}$ may be utilized to recalculate the parameters for the rotation cycle's continued circumrotation in one direction or the other in order to redetermine its parking with the cook-item returned to it's original initial front-facing placement location $F_P$ concurrent with the end of the redetermined cook-time cycle.

Background Overview

The invention affords a superior extent of safety and user convenience in enabling the removal of the heated cook-item from the microwave oven ("the microwave") by returning and re-parking the turntable near the same location at which it was when a microwave cooking cycle commenced.

In stark contrast and as expressed by Kang in U.S. Pat. No. 5,558,799 the turntable in known microwave ovens ordinarily stop in a random position relative with the front access. This uncertainty of end of cycle parking can result in both inconvenience and safety implications encountered by the user when taking food out of the microwave oven. ('799 Kang, col. 1, lines 52-58). To alleviate this shortfall '799 Kang reveals starting the microwave cooking and unidirectional rotation of the turntable at the same time. The cooking proceeds for a preset period of cook-time $CK_T$ and the cooking abruptly stops $CK_{TX}$. At this moment of the cooking stoppage, the turntable and a cook-item are likely to be situated in a random position relative with the cook-item's initial starting situation. In '799 Kang the turntable alone is programmed to continue it's unidirectional rotation, albeit cooking has stopped, until the turntable simply returns to about the same angular position that it was in when the cook-item was placed into the microwave. As a result, a considerable variation in time may occur between completion of the cooking and a moment when the microwave's access door may be opened to remove the cook-item. In a typical microwave oven having a 3-rpm turntable circumrotation rate, the turntable's overall circumvolution time period $TR_T$ is 20-seconds. Therefore, if a food-item is placed in the microwave for a 25-second warm-up, the '799 teaching stops-cooking about 5 seconds into the second 20-second turntable rotation period $TR_T$ and the turntable will continue to rotate for 15 additional seconds before rotation stops and the food is returned to the starting point and readily removable.

In another U.S. Pat. No. 5,440,105 Kim teaches a similar microwave oven operation in which the onset of cooking and the turntable rotation also begin together ('105 Kim Col. 3, Lines 36-39), the cooking cycle completes ('105 Kim Col. 4, Line 5) and "the turntable continues to be rotated" ('105 Kim Col. 4, Lines 17-18); also said in Claim 1 para. F (and G). In other words, although cooking has finished, the food continues rotating on the microwave oven's turntable for a considerable length of time before it may be conveniently removed. As earlier mentioned for '799 Kang the continued turntable rotation results in a potential delay of an uncertain and probably substantial number of seconds before the cook-item can be readily removed, during which time it may cool-down or undesirably "keep-cooking" due to residual internal heat buildup within the cook-item.

In yet another U.S. Pat. No. 7,351,943 Kubler reveals a motor mechanism for driving the microwave oven's turntable. After the microwave cooking time has "lapsed" (viz, stopped) the '943 Kubler mechanism intends to continue rotation of the turntable (viz, annular body) until it stops with "an item placed on the [annular] body conveniently remains identically oriented at a beginning and an ending of the cooking time." As earlier mentioned for '799 Kang and '105 Kim it is found that '943 Kubler merely maintains the continued turntable rotation after the cook-time is completed, which results in a potential delay of an uncertain and probably substantial number of seconds before the cook-item can be readily removed, during which time it may cool-down or undesirably "keep-cooking" due to residual internal heat buildup within the cook-item.

Benefits of Invention

The main goal and hence the main benefit to a user of this invention pertains to always returning, stopping and re-parking the turntable of the microwave at it's initial (starting) position $F_P$ concurrent with a completion of the microwave heating cycle. This invention affords the user with a considerable advancement in convenience and perhaps even more importantly, greater safety. The safety aspect lays in 'the repeatable return of a heated beverage or cook-item to a predictable and readily accessible park-position similar to it's original placement situation $F_P$ when the overall cook-cycle began. As is well known, prior art microwaves have for a long time merely stopped the foodstuff, often in difficult to reach rearward positions on their randomly parked turntable that simply stops it's rotation at the end of the cook-cycle. This makes reaching into the microwave and retrieving a hot dish or cook-item a difficult if not hurtful experience. Not only is handling a hot item difficult, but a risk likelihood for scalding a hand or getting a puff of steam in the face when reaching-in and removing a "covered cook-dish" is exacerbated.

Heretofore a majority of the microwaves simply time the cook-cycle duration and shut-off. Ordinarily this infers that the microwave energy source, the turntable rotation motor and even the interior light simply shut-off at the same time. As a result, the cook-item is reparked on the turntable in any one of an unlimited number of random locations when the cook-cycle time completes.

The benefit of the invention is to satisfy a long felt need of reparking the cook-item on the microwave's turntable near the same location as what it was originally placed when an overall cooking cycle begins. This synchronization between cook-time and turntable position is accomplished by starting the overall cooking cycle and the turntable rotation at the same time. This earlier goal is now bettered by rotating the turntable in an initial direction for a first-half of the cook-time $CK_T$ and then reverse and counter-rotates for the remaining second-half of the cook-time, resulting in an OTT=Ø. Then the rotation and the cook-cycle stop at the same time. This will invariably find the turntable and the cook-item to be returned back to it's initial front-facing starting position concurrent with the ending of the cook-cycle, which is the fundamental essence of this invention.

An exemplary variant on this is to find a difference between the cook-time $CK_T$ and a rotational time period $TR_T$ for an mathematically even "floor-integral number" of 360° turntable $RT_N$ rotations that exceeds the cook-time. Only the turntable is rotated for a time less than $TR_T$ equated by the found difference before the cook-cycle is turned-on. As a result, the turntable is subsequently rotated for a time equating with the even floor-integral number $RT_N$ of circumvolutions including a part of the initial circumvolution not completed before the cooking power is turned-on. As a result, the cooking power and the turntable rotation are synchronously timed to stop at the same moment and the cook-item has been returned to its initial front-facing emplacement situs $F_P$.

Problems Solved by Invention

A microwave oven having a rotating turntable accepts placement of a cook-item or beverage at a front-facing or "home" turntable situs directly accessed through an access portal such as a doorway. A user determines an entry of a preferred cook-time $CK_T$. The entered cook-time usually has a random relationship relative with the turntable circumvolution time. As a result, when the cooking or heating of the placed cook-item is completed, convenient and safe access and cook-item removal may be impeded by a random parking of the heated item. In other words, as the turntable rotates, it stops at an unpredictable angular position that may leave the heated item in the "back" of the cooking compartment, for example up to ±180° from the original cook-item entry placement location $F_P$. The undesirable result establishes a potentially dangerous situation for the user, when the heated cook-item and container must be lifted forward and out of the oven compartment. It is well known that covered items in a microwave dish often develop considerable "super heated" steam potential that may be accidentally released by even slightly lifting the cover or tilting the dish while drawing the cooked item forward from the back of the oven compartment. As a result, severe scalding can occur.

In a particular class of contemporary microwave ovens, specifically known as "over the range" models, the undesirable rearward parking of the hot-item draws the user into a precarious face-level situation where the hot-item must be lifted forward and down. This setting is obvious in its risk of causing an accident where steam or liquids from the heated item may be released or spill onto the user or into the user's face and cause scalding, or at the very least, a mess. Having the heated cook-item invariably come-to-rest or be parked in a forward position, nearest the open door and in the original initial placement location $F_P$ clearly obviates much of the heretofore unavoidable risk involved in removing an item from the microwave, whether overhead "over the range," or sitting on a counter-top.

The invention addresses both user convenience and user safety. The invention removes a substantial part of the liquid spillage and steam scalding risk involved in removing a hot cook-item (such as vegetables, soup or beverage) from a randomly parked turntable location in the oven compartment.

An interruptive change in cook-time such as premature stoppage of the cook-time cycle or else adding a few extra seconds or minutes to the initial cook-time introduces a probability for the turntable supported cook-item's stoppage in other than the original initial placement location $F_P$. This invention intends to provide for mostly overcoming the random stoppage issue.

When the cook (user) causes a premature stoppage of cook-time the turntable's angular position is determined and a direction of continued rotation involving the smallest return-direction angle is enabled. The turntable may either continue to rotate to it's parking site, or conversely if it would be quicker, the turntable rotational direction reverses and it counter-rotates to it's parking site adjacent with the access portal. This continued rotation and optimal reparking of the turntable subsequent to the end of cooking may be programmed to occur either with the door-open or door-closed.

In event the cook chooses to add more time to the initial cook-time instruction, the turntable's bidirectional rotational parameters are recalculated in view of the newly introduced extent of remaining cook-time. A recalculation of a bidirectional rotation pattern is submitted to the turntable's drive motor system with the goal of optimally reparking the cook-item near the original front-facing placement location $F_P$ concurrent with the completion of the cook-cycle.

On the other hand, if the cook prematurely interrupts a cook-cycle, the heated cook-item may be in any number of random turntable orientations relative with the original initial placement location $F_P$. When the cook re-enables the cook-cycle, the cook-item continues to be heated and the turntable resumes it circumvolution, essentially regaining its overall synchroneity relative with the overall cook-cycle parameters. On the other hand, if cook-cycle interruption includes a full stoppage and a cancellation of remanent cook-time, the desultory final interruption of the cook-cycle is compensated for by determining the cook-item's angular location relative with a desired parking site. If the angle is smaller in the direction of travel when the final interruption occurs, the turntable continues to rotate to the desired parking site and stop, albeit the cooking already stopped when the final interruption was initiated. On the other hand, if the smaller angle is in the direction opposite the immediate rotational direction, the turntable's direction is promptly reversed and counter-rotated until it stops upon reaching the desired parking site adjacent with the access doorway.

In any of its expressed embodiments, this invention invariably parks the "finished-cooking" and usually hot cook-item or beverage "forward-facing" relative with the access doorway. As a result, when the cook-time cycle is completed the heated cook-item is reparked in it's original front-facing initial placement location $F_P$ adjacent with the access doorway to provide an optimal orientation for convenient and safe removal by the user with less likelihood of spillage, scalding and similar mishaps.

SUMMARY OF INVENTION

A new level of convenience and safety is afforded the user of the microwave by this invention's novel teaching. In a most simple representation of this invention, a cook-item $F_C$ is placed on the rotating turntable, the cook-time is set to heat for a selected period of time $CK_T$. The cooking commences and turntable starts rotating $DR_A$ in an initial direction and at a constant speed. The cooking continues until the turntable circumvolution has continued $DR_{TA}$ for one-half the cook-time $CK_{TA}$ whereupon the turntable's is promptly reversed and counter-rotated $DR_{TB}$ for the remaining half of the cook-time $CK_{TB}$. As a result, the angular displacement of the two differing directions of OTT (overall turntable travel, viz, overall rotation) are effective to mutually cancel one-another $$(\text{e.g., OTT}=DR_{TA}-DR_{TB}=\emptyset=F_P)$$

and the cook-item is returned and parked adjacent with the original front-facing placement location $F_P$.

The bidirectional turntable's rotational period occurs concurrent with the cook-time $CK_T$ and the rotation may be subdivided into a number of smaller increments $DR_{TA1}$, $DR_{TA2}$, etc. with equivalent results. The only restriction is that the turntable's collective time-period $DR_{TA}$ of forward direction of rotation events and overall angular displacement must be equal to a time-period $DR_{TB}$ of the counter-rotated angular displacement and that the total rotational time-period is equal with the cook-time:

$$(DR_{TA1}+DR_{TA2})+DR_{TB}=CK_T$$

and that a total extent of the several forward direction increments and the contrarotation cancel one-another, viz $$\text{OTT}=(DR_{TA1}+DR_{TA2})+(-DR_{TB})=\emptyset.$$

Once the microwave cooking (and turntable rotation) start, a user might want to enter a change of cook-time, e.g., extend the cook-time $CK_{TX}$. Such a parametric change may be accommodated with a μP implementation by adding one-half the extension time, e.g., $CK_{TX}/2$ to the initial half of the original cook-time $CK_T$ and the turntable's forward rotation. Similarly the remaining-half of the cook-time extension $CK_{TX}/2$ is added to the conclusive half of the original cook-time $CK_T$. As a result, the turntable will angularly rotate further during its forward circumvolution and conversely fully retrace the additional forward rotation during the extended contrarotation with an ensuing return and reparking of the cook-item adjacent with the access doorway.

Another described variant of the invention which stops the turntable rotation $DR_A$ adjacent with the access doorway concurrent with an ending of the cook-time $CK_T$ is attained by delaying the start $CK_{SD}$ of the microwave cooking for a determined time after the onset of turntable circumvolution $DR_A$. The extent of cooking onset delay $CK_{SD}$ is calculated to deliver the end of the cook-cycle and simultaneously return and repark the turntable near its angular situation at the onset of the cook-cycle, thereby conveniently parking the cook-item adjacent with the access door at the end of the cook-time $CK_T$. As a result, even the most fastidious cook or chef is able to remove the cook-item immediately when the cook-time $CK_T$ elapses and the cooking stops. This implementation is particularly useful for very-short "warming" times, say less than about 5-seconds duration, because the absolute cook time may be more precisely controlled. A main drawback of this approach is that of encountering an increase in overall microwave oven operating time relative with the absolute cook-time $CK_T$. For example, if the turntable rotates $DR_T$ at 6-rpm and the circumvolution time $TR_T$ is 10-seconds with the turntable rotating at 36° per second (e.g., 60-sec/6-rpm=TRT=10-sec) or 36° per second, and with a 33 second cook-time $CK_T$ the delay $CK_{TD}$ between start of the turntable rotation and start of the cook-cycle is necessarily 7-seconds or 252° of turntable rotation. The 33-second cook-time $CK_T$ equates with 1188° of overall turntable rotational travel $TRT_A$ which is 3.3 circumvolutions CV [1188°/360°=3.3−CV] of the turntable and a 40-second overall operating time [33-sec+7-sec], As a result, the cook-time $CK_T$ and the OTT of the turntable rotation $DR_A$ reach a concurrent end-point with the cook-item advantageously reparked near the access portal.

This described example of a 40-second overall operating time may be lessened to merely 36-seconds. By determining whether the delay $CK_{TD}$ represents more or less than the 180° turntable midpoint, a savings in overall operating time is findable. For example, the 252° $CK_{TD}$ exceeds and therefore it is advanced nearer to the 360° end point, measuring 108° or 3-seconds of the turntable's circumvolution time $TR_T$. In other words, time is saved by initially rotating the turntable 3-seconds, or 108° degrees one way, then reversing the turntable and subsequently counterrotating it for the duration of $CK_T$, (e.g., 1188° or 3.3-circumvolutions) in the opposite direction. As a result, the cook-item is invariably reparked near it's initial starting point. Voilà, the 40-second time has been reduced by 4-seconds to 36-seconds—and merely 3-seconds longer than the actual cook time which ends concurrent with an absolute return and reparking of the turntable near the entry point.

An exemplar variant of this invention rotates the turntable in an initial direction $DR_A$ for a portion $DR_{AT1}$ of one-half the cook-time $CK_T$ followed by counter-rotating the turntable $DR_{BT}$ for one-half the cook-time $CK_T$ again followed by reversing and resuming rotation of the turntable in the initial direction for a remaining portion $DR_{AT2}$ of the cook-time $CK_T$ [e.g., $DR_{AT1}+DR_{AT2}+DR_{BT}=CK_T$] assuring the OTT=Ø and the cook-item $F_C$ on the turntable is returned and reparked near the initial starting location, usually adjacent with the access portal. This shows that the initial rotation and counter-rotation may be fragmented as long as the total rotation time is equal to the cook-time $CK_T$ and the angular extent of the two rotational directions cancel out $$[\text{e.g., } OTT=DR_{AT1}+DR_{AT2}+(-DR_{BT})=\emptyset]$$

assuring the return of the cook-item $F_C$ to the initial placement location $F_P$ near the access portal concurrent with the completion of the cook-time $CK_T$.

It is not unusual for a cook to add-to or else change the original cook-time entry during the actual cooking cycle. As a result the synchronization between the initially entered cook-time and the turntable's rotational parameters calculated to reach the optimal reparking position near the access portal are lost. This invention accepts the added or changed cook-time parameter and utilizes it to recalculate a new set of rotational parameters for instructing the turntable's overall circumrotation pattern to reattain the optimal synchronization between the changed cook-time and the turntable that is necessary to achieve a most-probable reparking of the cook-item near it's original front-facing placement location $F_P$.

In a more contrary situation, the cook may prematurely stop, e.g. interrupt, the cook-time cycle. For example, in the aforesaid example having a 10-second turntable circumrotation time $TR_T$ and using the 33-second cook-time $CK_T$, the cook might choose to interrupt the cooking after 27-seconds. This results in the cook-item cooking being stopped with the turntable only 972° into its original calculated 1188° and 252° into it's final travel lap. It results in the turntable be near 144° when the cooking stops. This description reveals that since [144°<180°] e.g., less than the farthest 180° location, the turntable rotational direction must be reversed and it will most-quickly return to the front-facing original placement location $F_P$ within 4-seconds after the cook-time has been interrupted.

The invention is described utilizing several classes of motor drives. Microwave ovens commonly use induction motors to drive the turntable. Induction motors are readily reversed, are cost-effective and have a reliable performance history. This invention is highly amenable to utilize induction motors. Stepper motor and brushless DC motor drives are also known to be useful for operating this invention while exhibiting considerable flexibility for efficiently changing directions, usually under microcomputer (μP) control.

What this Invention "is" and "is-not"

This invention "is not" about merely shutting off the microwave oven when the cooking ends and leaving the cook-item randomly displaced on the turntable other than with the original initial placement location $F_P$ adjacent with the front-facing access doorway portal.

It furthermore "is not" about a simultaneous start of microwave cooking and turntable rotation and a subsequent stoppage of the cooking prior to a random and otherwise indeterminate time before finishing a return and reparking the turntable near it's original initial placement location $F_P$ conveniently and safely adjacent with a front-facing access doorway portal.

This invention "is" about rotating the turntable forward for one-half the cooking time $CK_T/2$ followed by counter-rotating the turntable for a remaining one-half of the cooking time, where the "to and fro" rotation returns the cook-item on the turntable back to it's initial starting location adjacent with the front-facing doorway access portal.

This invention "is" about creating an absolute end-point coincidence between a timed cooking interval and a food-bearing turntable's circumvolution time period by delaying onset of the timed heating period by an amount equated as the difference between the cook-time $CK_T$ and a time lapse of an integral number of turntable circumvolations $TR_T$.

This invention "is" about unconditionally starting and stopping the microwave cooking concurrent with a start and stop of the turntable's rotational return of the initial cook-item placement location $F_P$ reparked adjacent with the microwave's front doorway access portal upon the completion of the cook-time $CK_T$ cycle.

This invention "is" about assuring that the cook-item $F_C$ is always returned to and stopped near its initial front-facing turntable placement position $F_P$ concurrent with an end of the cook-time $CK_T$ cycle.

This invention "is" about enabling a change or extension in cook-time during the cook-time cycle with a corresponding change in the turntable's rotational parameters which assures the return of the food-item to its initial front-facing starting location adjacent with the doorway access portal.

This invention "is" also about accommodating an early interruption of a cook-time $CK_T$ cycle with an automatic return of the cook-item to its initial starting location adjacent with the front-facing doorway access portal.

This invention "is" about enabling a manufacturer to update a pre-existing microwave oven design to include unique safety and convenience features.

Objectives of Invention

An objective of the invention is to re-park a cooked food-item $F_C$ at the end of the cook time $CK_T$ in substantially the same front-facing turntable position where it was initially placed $F_P$ at the onset of the cook-time $CK_T$ cycle.

A purpose of the invention is to maintain a synchronic relationship between the microwave's turntable rotational position and preferred cook time to enable a return of the cooked item to a position adjacent with the oven's access portal at the end of the cook-time cycle.

A gist of this invention is to absolutely re-park a cooked food-item directly in front of the door-opening access portal on the microwave, regardless of the duration of the selected cook-time $CK_T$.

A key purpose for the invention is to provide convenient and safe access to a heated, cooked food-item at the end of the microwave's cook-time $CK_T$ cycle.

A further goal is to satisfy a long-felt need by including the assured concurrency between the cook-time $CK_T$ cyclic completion and the reparking of the turntable with the cook-item reparked adjacent with the access doorway of a microwave oven of conventional design with a minimum or re-engineering.

The essence of this invention is to provide an inexpensive new level of user convenience for a common problem that involves safe and easy removal of very hot food-items from the microwave's cooking chamber.

It is a further intent to rotate the microwave oven's turntable at various speeds to assure it's return to the starting point upon completion of the cook-time $CK_T$ cycle.

Additionally this invention finds suitability for being gainfully engineered into microwave ovens of virtually any size and configuration which utilize a nearly ubiquitous rotating turntable for receiving, cooking and reparking the cook-item adjacent with the front-facing door opening.

A further goal of this invention is to reveal economical inclusion of it's features in a maker's pre-engineered microwave oven design.

This invention intends that a user may find better safety, convenience and overall satisfaction utilizing the microwave having this invention's novel enhancements.

Another objective of this invention is to uniquely overcome the inconvenient and unsafe random stopping and awkward parking of a food-item found in a conventional turntable provision.

DESCRIPTION OF DRAWINGS

This invention is depicted by 16 sheets of drawings showing 16 figures, including.

DESCRIPTION OF INVENTION

Figure 1:
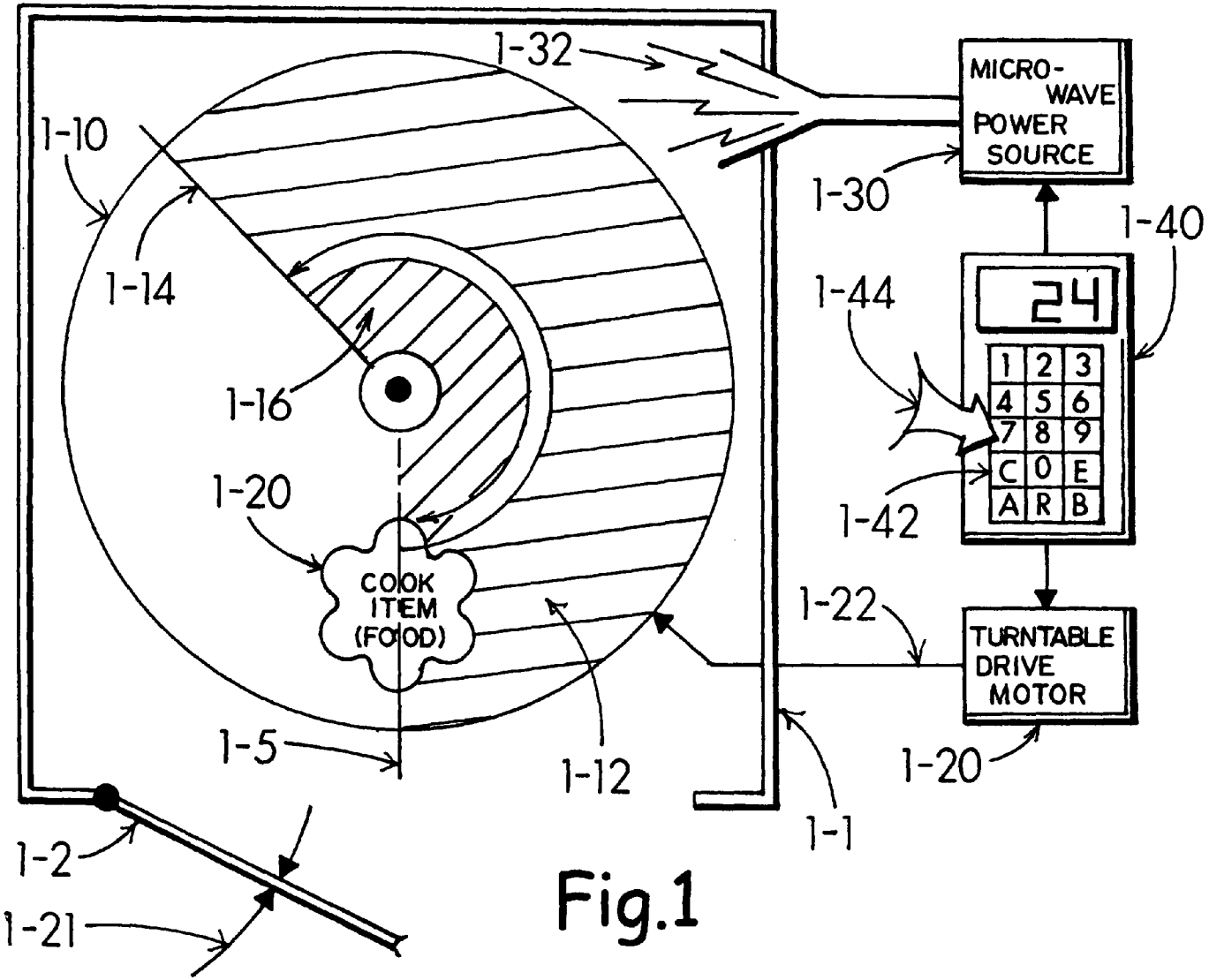
FIG. 1—An overall concept view of turntable action reparking near the start point.

A microwave oven layout is depicted in FIG. 1 that includes a casing 1-1 for a cooking chamber confined by a known extension of the casing 1-1 ordinarily on six principal sides (not shown) to fully enclose the cooking chamber while allowing an accessible 1-3 doorway 1-2 to enable a convenient "front loading" of the cooking chamber. A circumvolutory table 1-10 is situate on the bottommost portion of the chamber, allowing a user to readily place a cookable food item 1-20 at a frontal location on the turntable 1-10 as accessed through the doorway 1-2. As this FIG. 1 shows, the turntable 1-10 is gyrated by a bidirectional turntable drive 1-20 coupled 1-22 with the turntable axis. Microwave excitation energy 1-32 for inducing frictional heating of the cook-item is known to be produced and delivered by a magnetron microwave source 1-30. The user may set 1-44 a preferred cook time and other process parameters utilizing a keypad 1-42 portion of the control panel 1-40.

In this FIG. 1 depiction, the turntable rotates forward 1-12 for a first-half of the user's selected cook-time $CK_T$. When the midpoint 1-14 of the cook-time is reached, the turntable reverses and counter-rotates 1-16 and reparks concurrent with a completion of the cook-time $CK_T$. At the conclusion of the cook-time $CK_T$, the bidirectional rotations of the turntable will have mutually canceled and returned the cook-item 1-20 to the same front-facing position 1-5 as where it was placed at the onset of the cook-time and initial turntable circumvolution.

Figure 2:
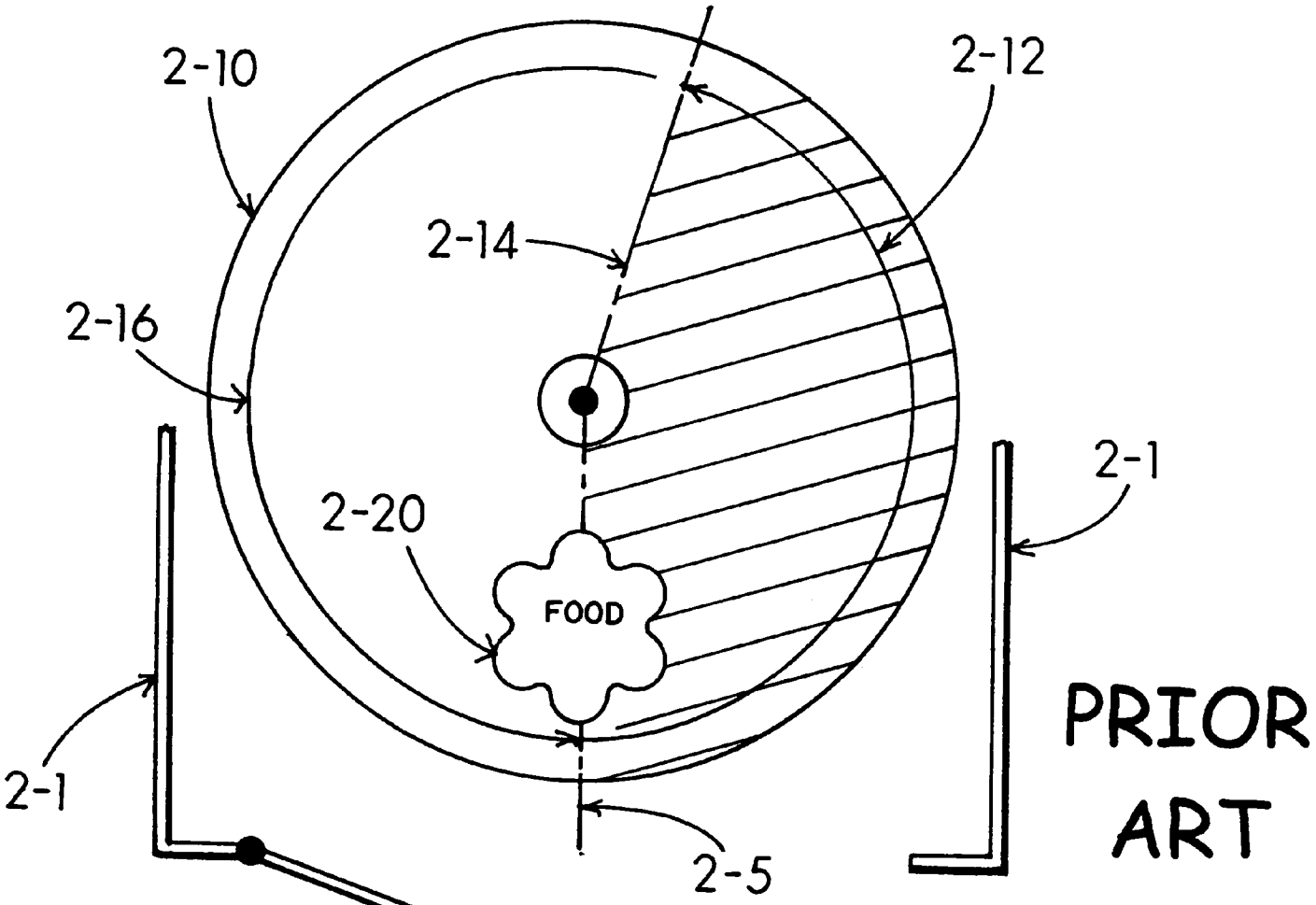
PRIOR ART Fig.2
FIG. 2—A turntable rotation pattern for a PRIOR ART microwave.
Figure 3:
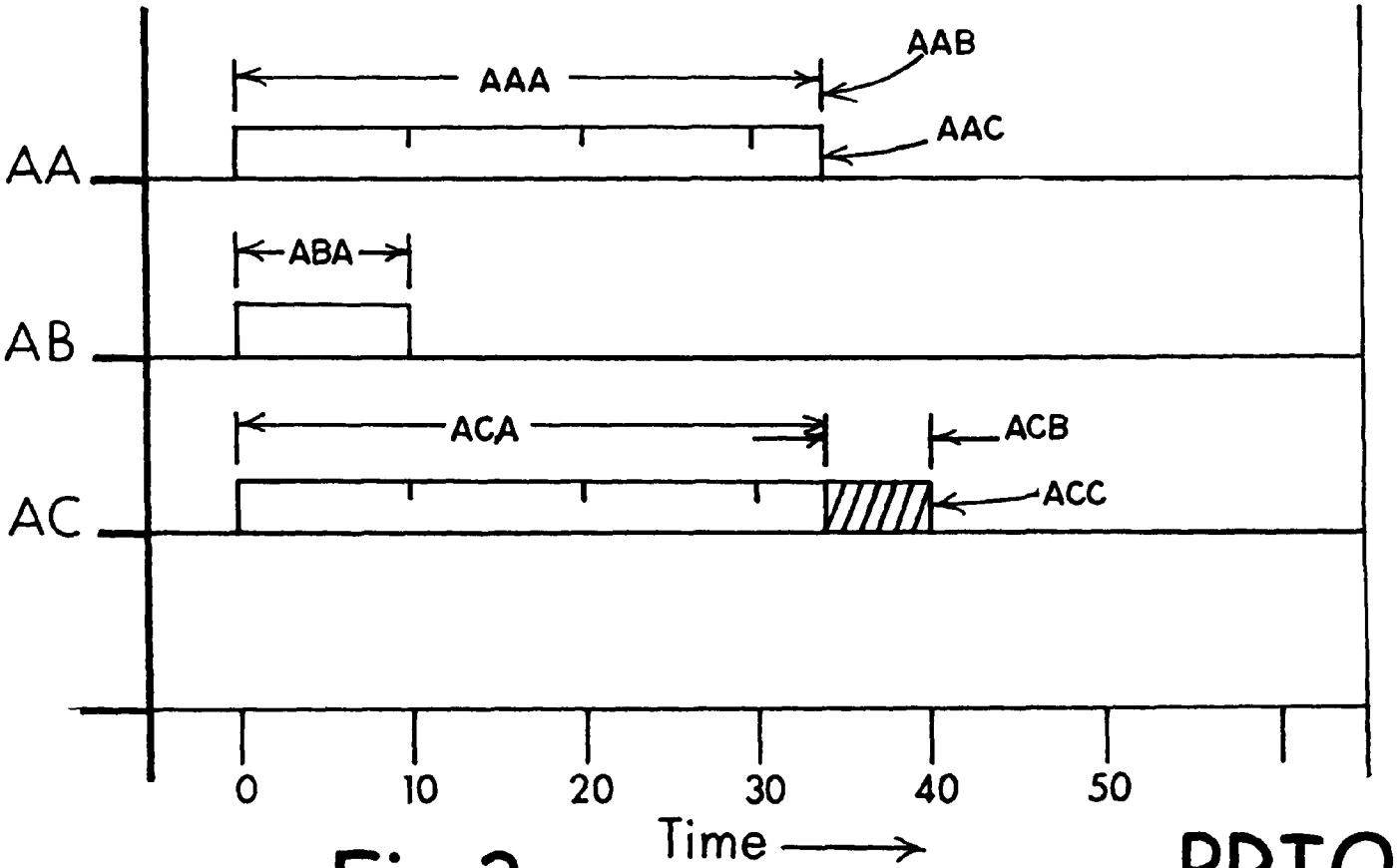
PRIOR ART Fig.3
FIG. 3—A timing chart for the PRIOR ART turntable rotation depicted in FIG. 2.

The showing of FIG. 2 depicts a stereotypical representation of the prior art of Kang U.S. Pat. No. 5,558,799, Kim U.S. Pat. No. 5,440,105 and Kubler U.S. Pat. No. 7,351,943 in which the turntable 2-10 containment 2-1 and doorway 2-2 enable a placement of the cook-item 2-20 on the turntable. This PRIOR ART differs from the current invention in that the turntable rotates concurrent with the cook-time for an extent 2-12 the microwave heating simply stops when the cook-time 2-14 times-out with the cook-item 2-20 at a random location relative with the front doorway 2-2. In other words when the microwave heating stops, the cook-item 2-20 may be situated far from the entering location 2-5. In these PRIOR ART teachings, after the cook-time ends, the turntable continues to rotate 2-16 towards the end-point 2-5. As a result, a considerable random variation in time-difference occurs between when the microwave heating has time-out and stopped and when the cook-item is returned to the initial entry location and is readily removable from the microwave oven. FIG. 3 particularly depicts this overall PRIOR ART with a depicted 34-second cook-time AAA. A single 360° circumvolution time for the turntable appears as 10-seconds ABA, for a fixed 6-rpm turntable speed. Therefore, to achieve the 34-second cook-time, the turntable rotates ACA for the time ABA×3 plus 4-seconds AAB The cook-time ends AAC while the turntable is 144° past the 30-second time and yet 216° shy of its desired park position ACC. As this PRIOR ART instructs, the turntable simply keeps rotating for the additional 6-seconds)(216° ACB after the cook-time ends and the microwave heating stops. In other words, the end of the microwave heating stops substantially ahead of the return and reparking of the turntable near its initial front-facing location 2-5.

Figure 4:
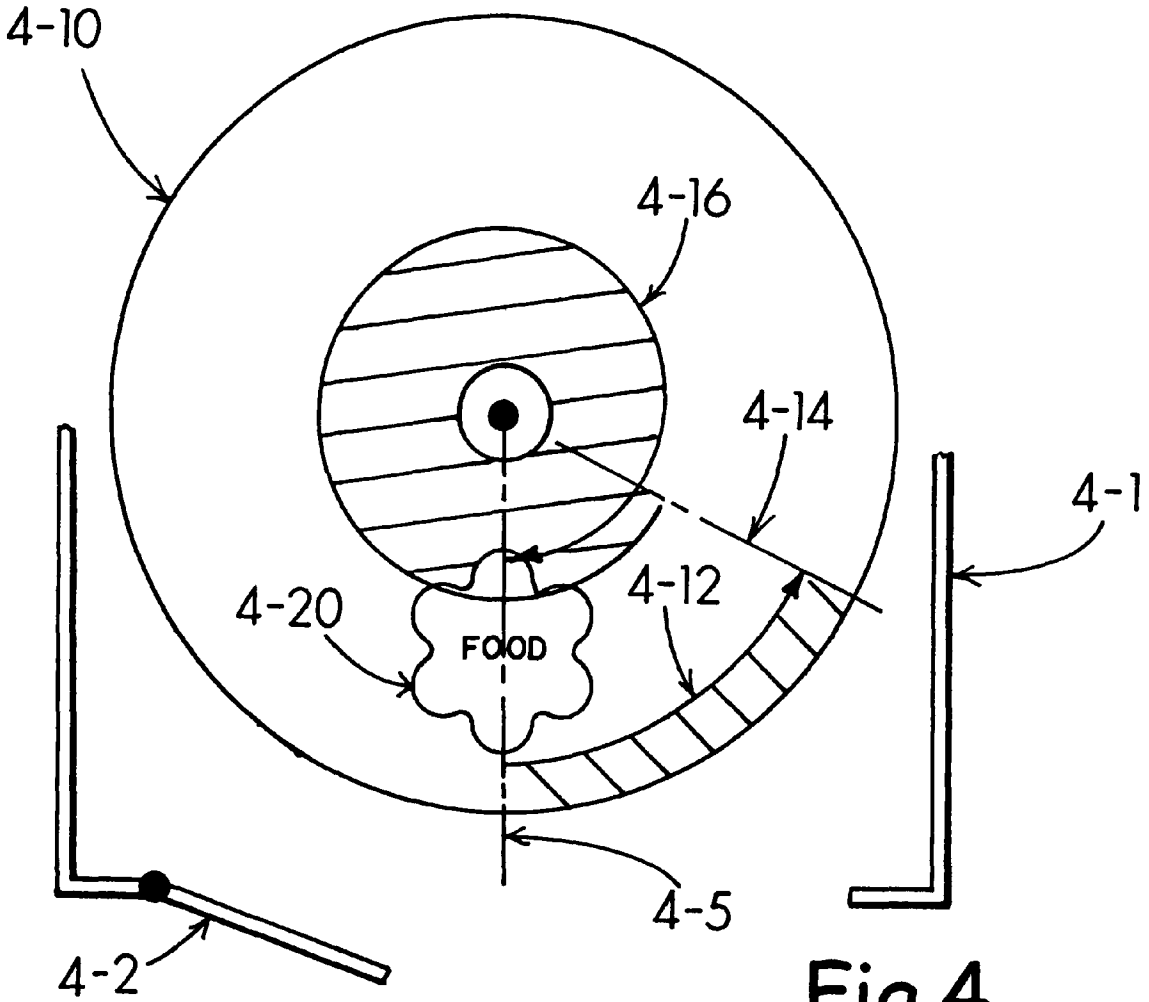
FIG. 4—A turntable rotation pattern for an overlap in turntable circumvolution time.

These PRIOR ART showings of FIG. 2 and FIG. 3 clearly depict microwave turntable operation which is the absolute antithesis of the overall operational performance proclaimed by this invention and as discussed relative with FIG. 1 and now further taught in FIG. 4. A turntable 4-10, contained in an enclosure 4-1 having a doorway 4-2 enabling a convenient access point for placement of a cook-item in a frontal position 4-5 on the turntable. A preferred cook-time is defined which, as shown in FIG. 4, exceeds the full circumvolutory time of a 6-rpm rotation time for the turntable 4-10. For example, with a 14-second cook-time (e.g., warming a bun, etc.) the turntable may rotate 4-12 forward for 2 seconds, then reversing 4-14 and counter-rotating 4-16 for 2 second plus 10-seconds (e.g., 12 seconds) as depicted by the spiral 4-16. Cooking is maintained throughout this operational cycle (depicted by shaded lines) and as a result, the cook-item is heated for 14-seconds and the cook-item 4-20 simultaneously returns and reparks in its initial front-facing location 4-5.

Figure 5:
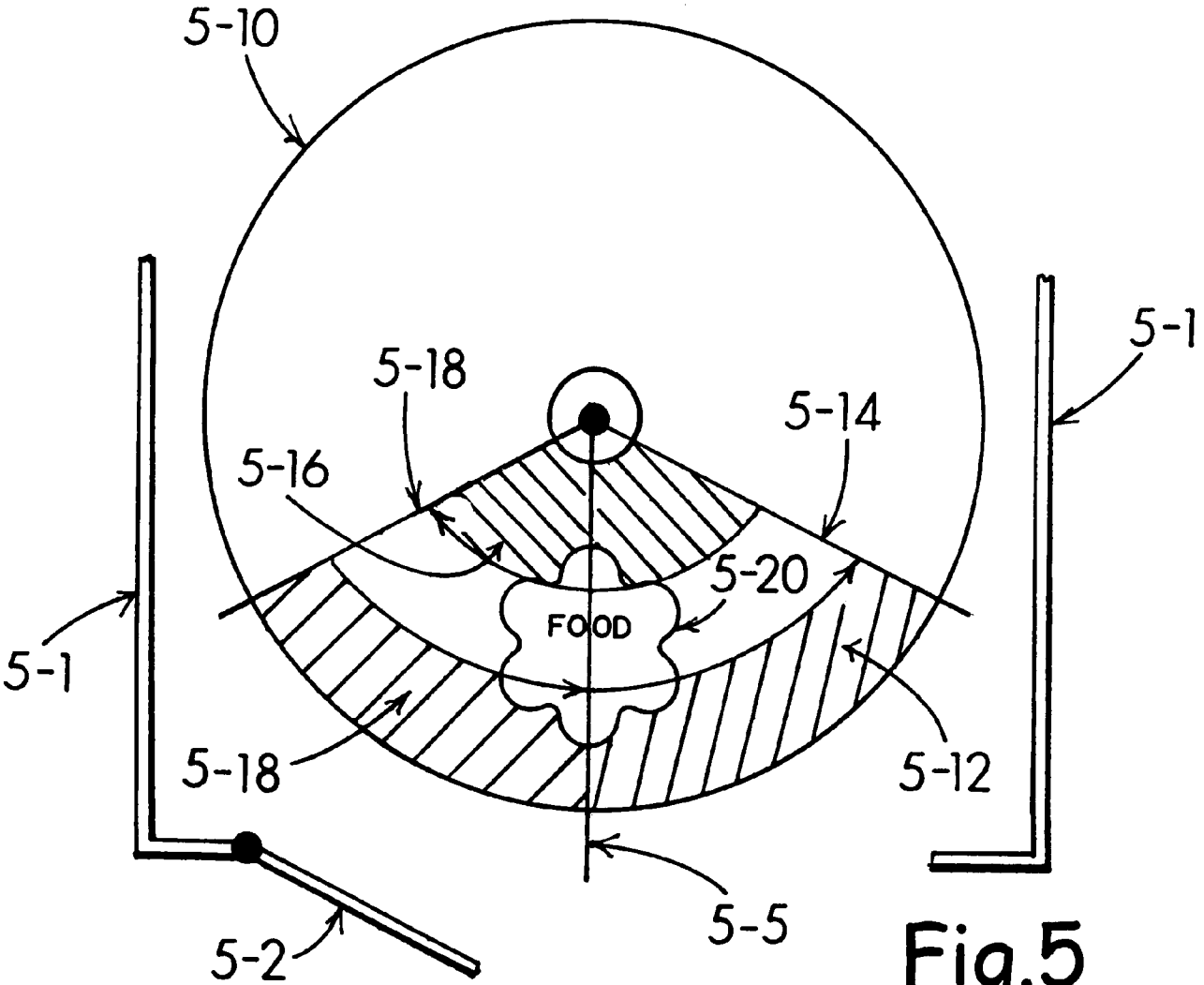
FIG. 5—A timing chart for depicting the turntable action of FIG. 4.

A variation on this cook-time $CK_T$ cycle is depicted in FIG. 5 to include the turntable 5-10 rotating at 3-rpm (18°/sec.) and enclosed 5-1 with an access doorway 5-2 enabling a cook-item 5-20 placement to be "front facing" 5-5. A user-preferred 16-second cook-time is depicted which is essentially split into four quarters of 4-seconds each. During the first 4-second quarter the turntable forward-rotates 5-12 until 4-seconds elapses (about 72°) and stops 5-14 to reverse and counter-rotate through two-quarters of 8-seconds (about 144°) and again stops 5-18 and again forward-rotates 5-20 for a remaining 4 seconds (about 72°) resulting in the cook-item being returned and reparked at the initial front-facing placement 6-5. Hence, the cook-time is completed concurrent with the return and reparking of the cook-item in the initial front-facing position.

Figure 6:
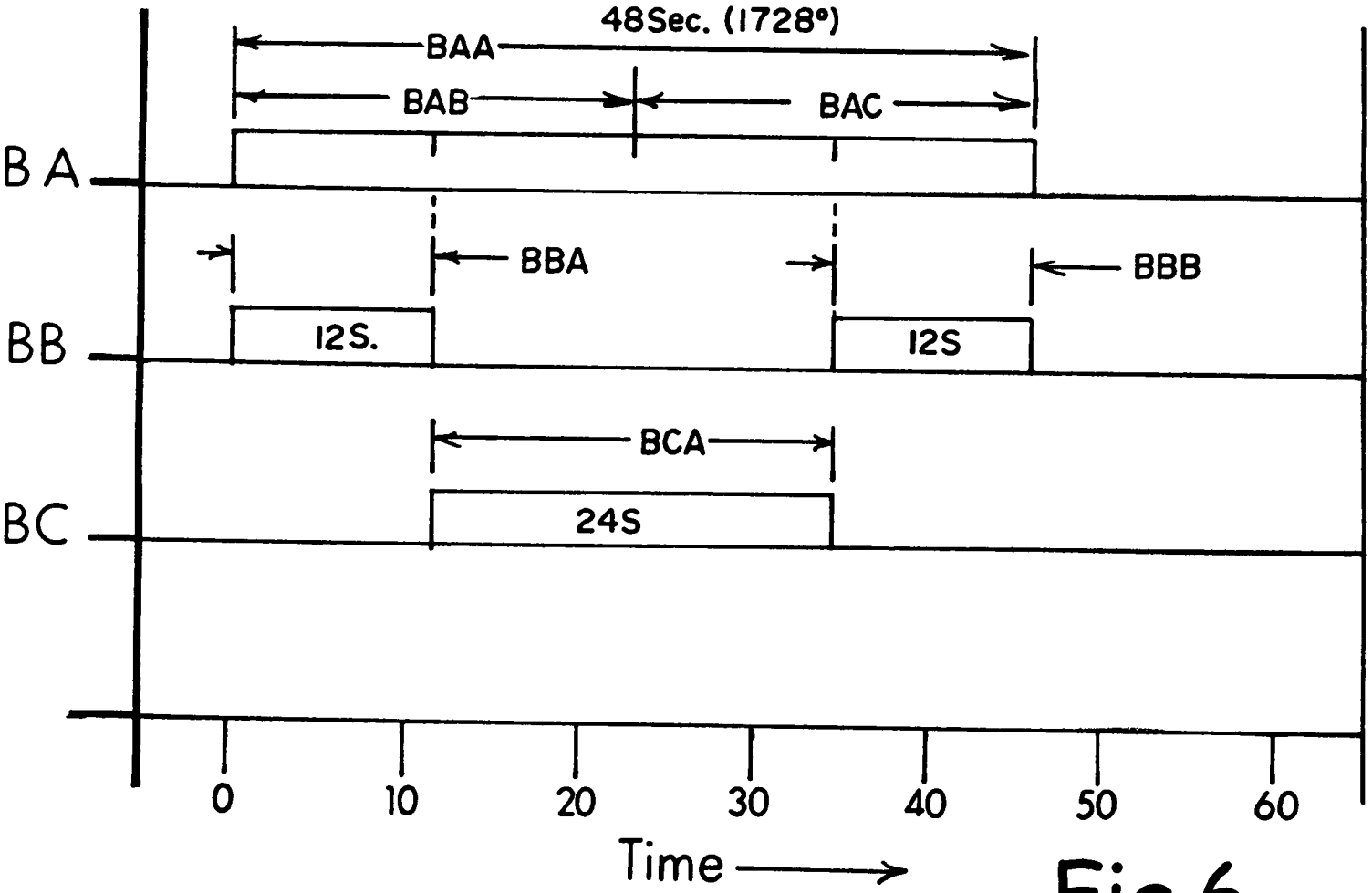
FIG. 6—A turntable rotation pattern achieving a tri-directional circumvolution sequence for achieving reparking adjacent with the microwave's doorway.

A furtherance of this overlapping operation appears in FIG. 6 where the overall cook-time BAA, say 48-seconds and a constant 6-rpm turntable speed (36°/sec.) may urge forward rotation of the turntable about 432° for an interval BBA of 12 seconds, followed by 24 seconds (−864°) of counter-rotation BCA and completed with a final 12-seconds)(432° of forward rotation BBB, allowing the turntable's return to the starting location 6-5 (Ø°) concurrent with a completion of the cook-time $CK_T$. In effect, the turntable's constant forward-rotation periods BBA+BBB and the counter-rotation period BCA mutually cancel one-another and the cook-item returns to its initial position and virtually reappearing adjacent with the access doorway as though it had never even moved.

Figure 7:
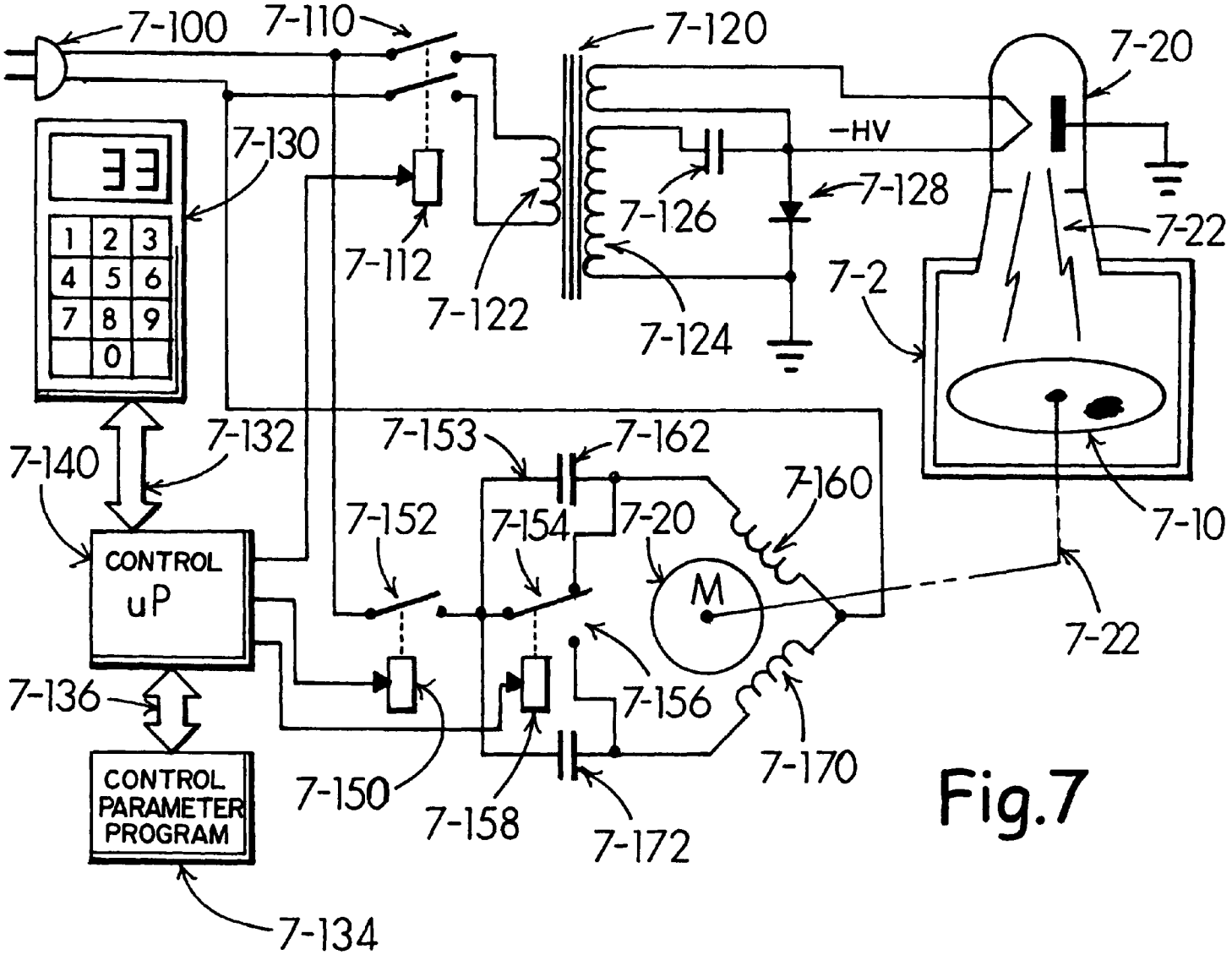
FIG. 7—A schematic diagram for a representative microwave suitable for practicing the invention.

A suitable microwave embodiment is schematically depicted in FIG. 7 to include the oven enclosure 7-2 supporting the rotating turntable 7-10 and the microwave energy source (magnetron) 7-20. Incoming utility power 7-100 is routed through a contactor (relay) 7-110 with a transformer 7-120 primary 7-122. The transformer secondary 7-124 is coupled in a voltage-doubler arrangement in conjunction with capacitor 7-126 and diode 7-128 to ordinarily provide a source of several kilovolts of negative high voltage −HV for the magnetron filament (e.g., cathode) element relative with the grounded anode.

The user interface includes a control panel 7-130 which enables a user entered selection of time and other commands coupled 7-132 with a control processor μP 7-140 running under command instructions of a program 7-134 also coupled 7-136 with the processor. The resultant cook-time command signal couples with the contactor (relay) coil 7-112, thus energizing the transformer 7-120 for a duration of the selected cook-time $CK_T$. Turntable rotation is initiated by a control signal urging relay coil 7-150 to close contacts 7-152, thus applying "forward" power through the NC contacts 7-154 of a relay 7-158 that couple with a "forward" motor winding 7-162. The other motor winding 7-170 similarly couples through a phase-shift capacitor 7-172 with the relay contact set 7-152 as joined with relay contact set 7-154. When the operating cycle calls for counter-rotation of the turntable, the relay coil 7-158 is energized, closing the contacts 7-156 routed to the juncture of the "reverse" motor winding 7-170 and phase-shift capacitor 7-162. As a result, the phase shift capacitor 7-162 is solely coupled with the motor winding 7-160, promoting counter-rotation of the motor 7-20 as coupled 7-22 with the turntable 7-10. It is well-known in the art that equivalent brush-type motor operation (e.g., "series" or "universal" motor) design may obtain ready reversal (albeit not shown) by relay contact rearrangement of power flow associated with a rotor relative with field windings.

Figure 8:
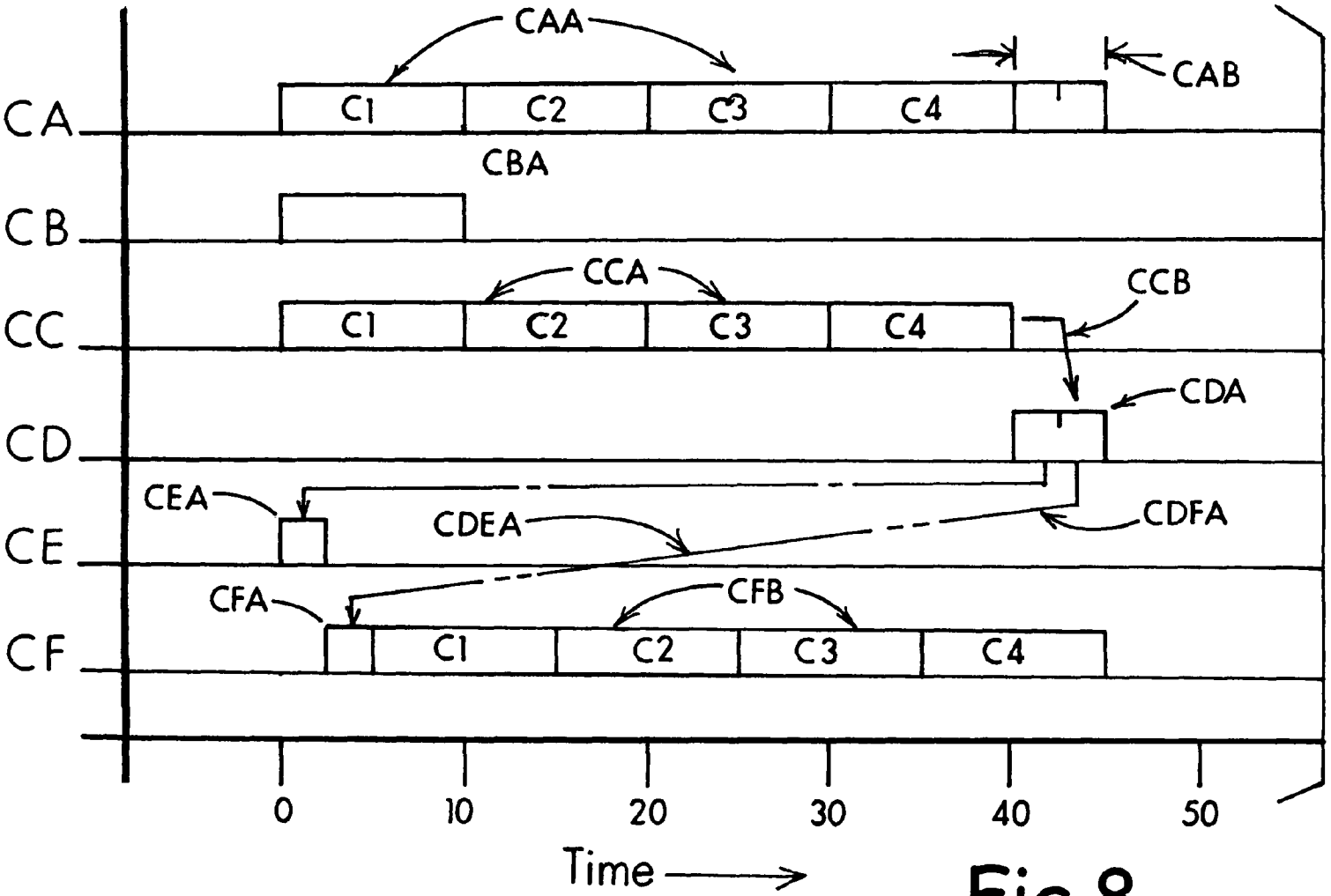
FIG. 8—A timing chart showing excedent time preceding the onset of the turntable circumvolution to run concurrent with the cook-time $CK_T$.

A 44-second cook-time $CK_T$ is exampled by depiction CAA+CAB in FIG. 8, operating in conjunction with a constant 6-rpm turntable speed (36°/sec.) to deliver a 10-second turntable circumvolutory time CBA. Upon initiating a "start," the overall 44-second cook time $CK_T$ is computed relative with the circumvolutory time CBA to derive a 4-second excedent time CAB. Line CC shows the 4-second excedent time CCB moved to line CD where it is effectively divided equally between CDEA a forward 2-second rotation time CEA, followed by coupling CDFA with the counter-rotation time CFA+CFB. In other words, the turntable rotates forward for one-half the excedent time CEA (e.g., 2-seconds) and subsequently counter-rotated for the concludent 2-second portion CFA of the excedent time followed by a counter-rotation continuation CFB for a remainder of the cook-time $CK_T$.

Figure 9:
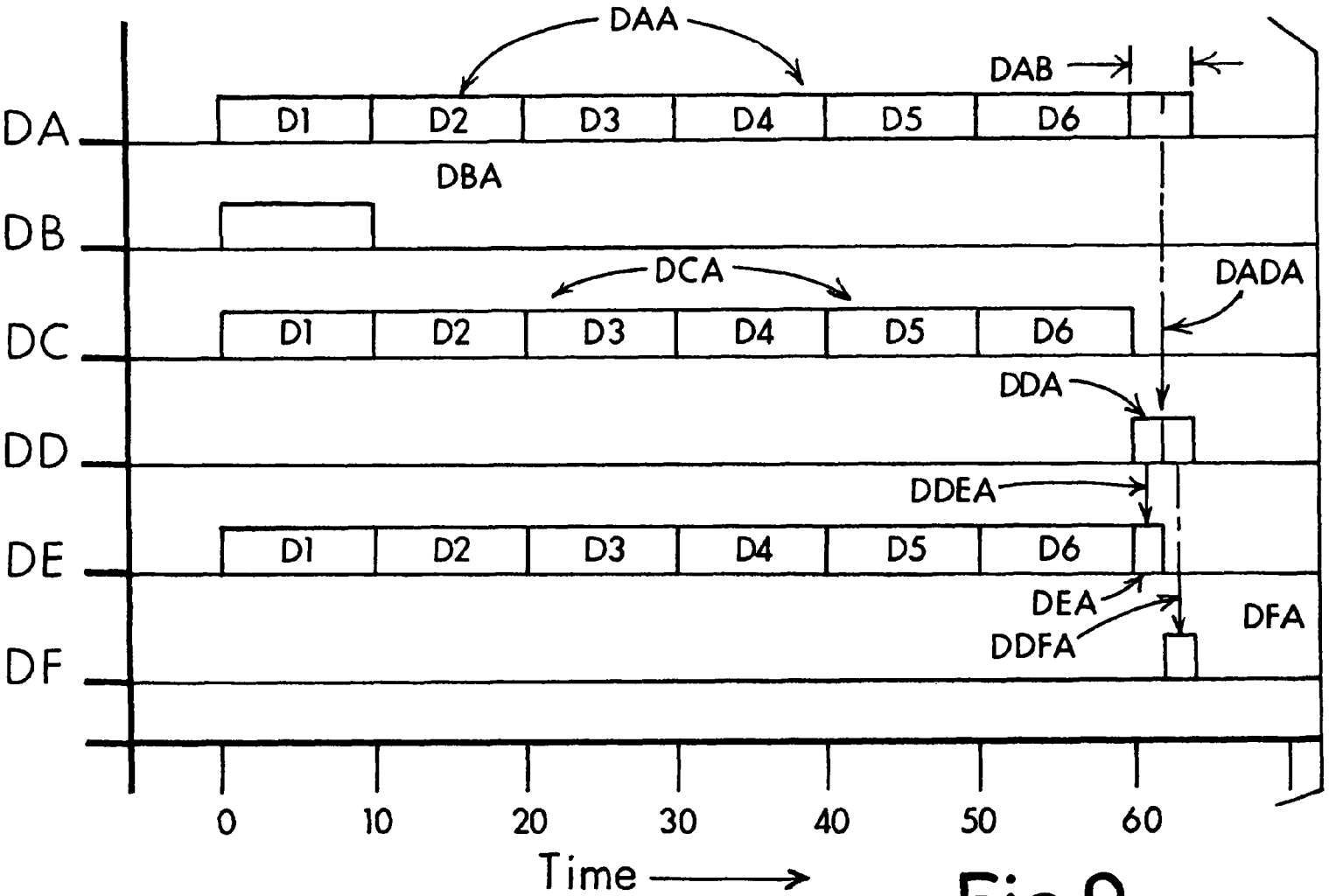
FIG. 9—A timing chart showing excedent time running concurrent with the cook-time $CK_T$ and following the completion of a predetermined number of 360° circumvolutions.

In FIG. 9 the an overall cook-time $CK_T$ of 64-seconds appears as DAA+DAB on line DA. An excedent time of 4-seconds DAB (e.g., 144°) is derived relative with the turntable circumvolutory time of 10-seconds DBA (36°/sec.). including determination of six complete turntable circumvolutions DCA (e.g., 2160°) during the clock time portion DAA (e.g., D1 through D6) of 60-seconds. A 4-second excedent time DAB is illustratively coupled DADA with the excedent time-line signal DDA and effectively halved into two 2-second interval signals (each affording 72° turntable rotation). The turntable is set into forward rotation DE for the 6 full circumvolutions D1 through D6 plus 72°, e.g., an initial one-half the excedent time DDA for a 2160°+72° extent of "forward" rotation. This depicts the 2-second time DEA portion of the excedent time DDA added DDEA onto the forward rotation to effect a continuation of rotation for a total of 62-seconds (2232° overall), with the remaining 2-seconds coupled DDFA with and urging counter-rotation DFA of the turntable for 72°, resulting in a return and reparking of the cook-item adjacent with the microwave's front access doorway 1-2. This shows that the 2232° forward rotation and 72° counter-rotation equates with six full 360° circumvolutions of the turntable which intrinsically reparks the cook-item in front of the access doorway, e.g., 2232°−72°=2160°/360°=6.

Figure 10:
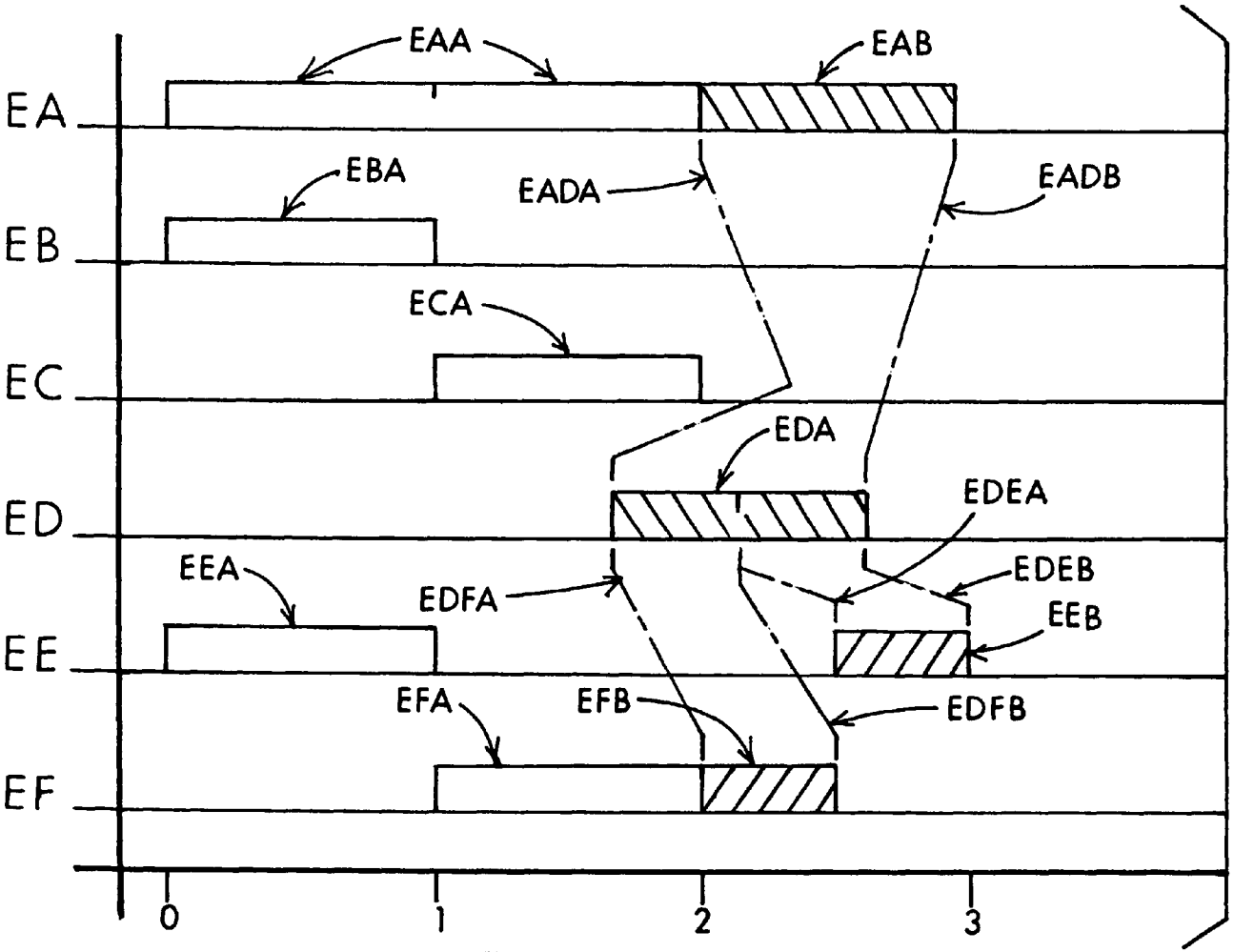
FIG. 10—A timing chart showing the addition of time blended into the turntable's operating time sequences.

A microwave user frequently "adds" time to an already heating cook-item. In FIG. 10, the original 36-second cook-time EAA is subsequently added-onto with a 17-second time extension EAB. In this showing, the original cook-time EAA is equally divided into two 18-second time intervals EBA, ECA that set the turntable's forward EBA and reverse ECA circumvolution times, and as depicted EBA=ECA. Initially, when the microwave is first started, the turntable is set into bidirectional motion, initially forward EEA for an initial half of the cook time EBA e.g., EAA/2, followed by a period of counter-rotation EFA for the concludent half ECA of the cook-time. Upon adding the 17-second time extension EAB, the equivalent time EDA is halved e.g., EDA/2, first adding the extended time EDFA, EDFB as a time extension EFB added to extend the current counter-rotation time EFA, e.g., EFA+EFB. The concludent half of the time extension EDEA, EDEB is added to the turntable's forward rotation control, resulting in a further forward rotation EEB subsequent to the counter-rotation interval EFA+EFB. In this showing, the overall forward rotation EEA+EEB is equal with the overall counter-rotation EFA+EFB, e.g.:

$$(EEA+EEB)-(EFA+EFB)=\emptyset.$$

The overall result is to produce a return and reparking of the cook-item adjacent with the microwave's front access doorway 1-2, even when more time EAB has been added to the original cook-time EAA ($CK_T$).

Figure 11:
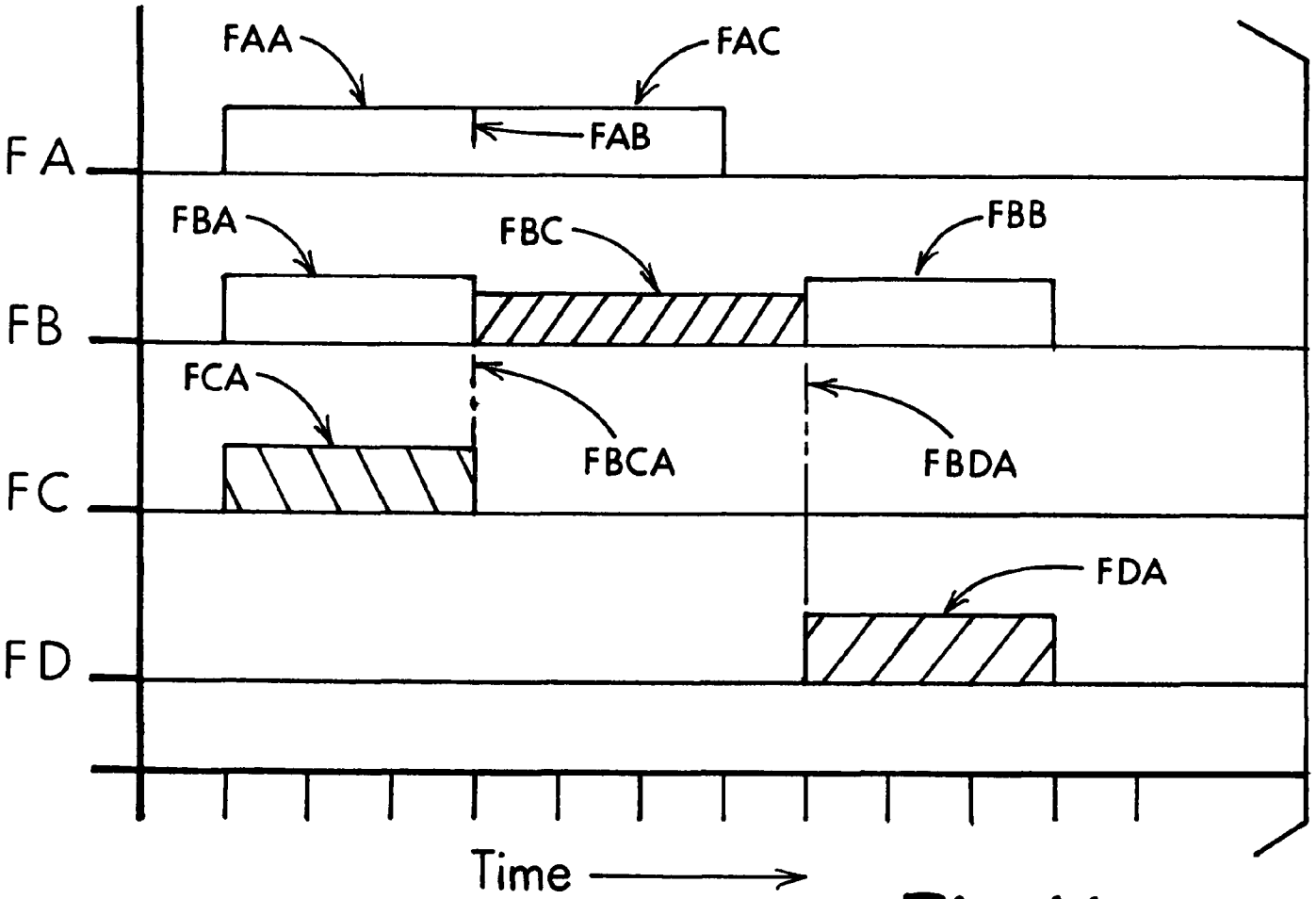
FIG. 11—A timing chart showing a pause during the middle of the cook-time $CK_T$ cycle conditioned to repark the turntable in its initial location near the doorway.
Figure 12:
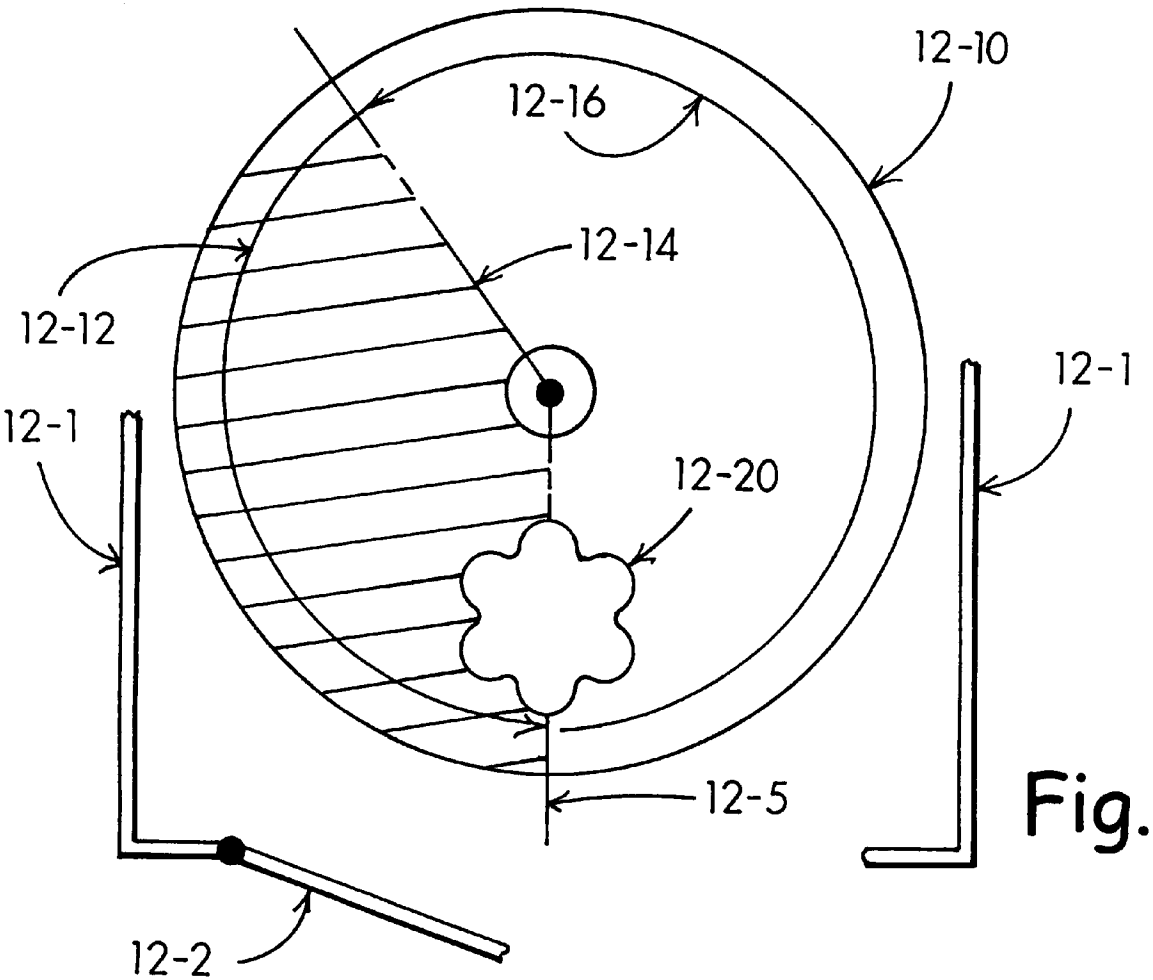
FIG. 12—Modification of a conventional microwave design to include new features of safety and convenience.

A cook using a microwave for food preparation often encounters a recipe that calls for a mid-cycle pause of the microwave heating without interrupting the overall cook-time $CK_T$. An accommodation for mid-cycle pausing appears in FIG. 11 where the initial cook-time is set FAA. For example, prepared dinners often call for this style of cooking, with a mid-cycle pause. As this depicts, the initial portion of the cook time FAA (about one-half) enables a first portion of the cook cycle FBA concurrent with a forward rotation FCA of the turntable. The pause time FBC couples FBCA with and stops the turntable motor and microwave heating source operation for the duration of the pause entry FBC. A lapse of the pause time is followed by the remaining cook-time FAC re-enabling and continuing the microwave heating source FBB and to couple FBDA with the turntable drive for urging counter-rotation FDA for the remaining cook-time $CK_T$ duration FAC. The overall result is a return and reparking of the cook-item adjacent with the microwave's front access doorway 1-2 subsequent to the overall time event FB, including the mid-cycle pause time FBC combined with the split cook-times FBA+FBB. In this showing, the microwave heating and the turntable rotation are concurrent events, with the turntable returning and reparking in a front-facing position adjacent with the microwave's front access doorway 1-2 at the end of the overall cooking cycle.

Figure 18:
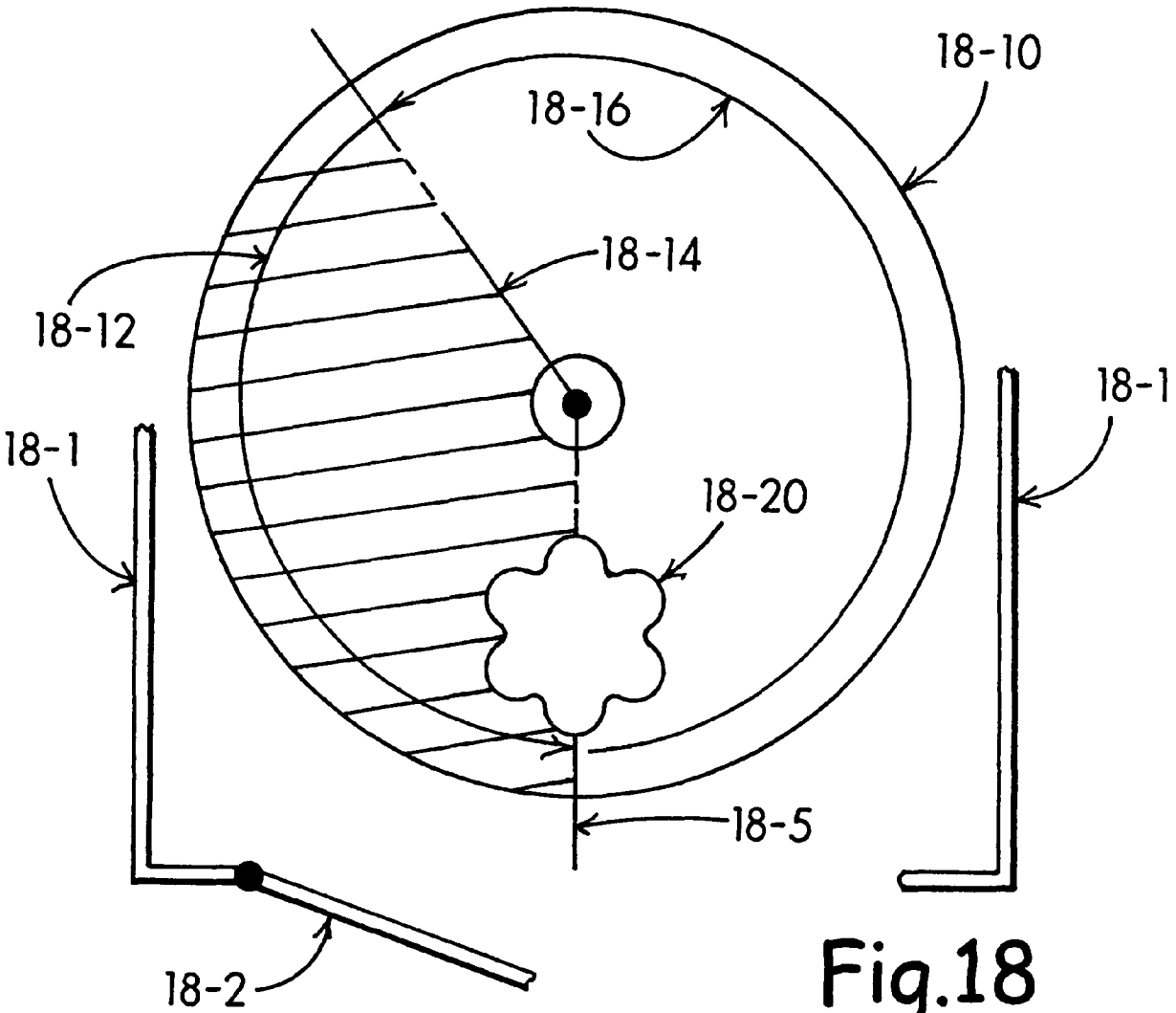
FIG. 18—Modification of conventional microwave to include new features of safety and convenience.

An exemplar showing for implementation of this invention in conjunction with a conventionally designed microwave is depicted in FIG. 18. Conventional commercial microwaves typically have unidirectional turntable rotation, albeit the actual rotational direction may reverse each time the microwave is turned off and on. This schema is based on counter-clockwise, or left-to-right turntable circumvolution within the oven containment 18-1. In this example, a heating time of 4-seconds is exemplified. Such a brief cook-time is oft used to just "warm-up" some food item, such as a donut, whereas a longer cook-time would ruin the food item. It is the essence of this invention to stop turntable rotation and microwave heating at the same moment and end-spot 18-5, whilst the cook-item is returned to the front of the microwave for easy removal. In this conventional microwave having a 6-rpm turntable rate, the control electronics is readily re-engineered to close relay contacts 7-152 (FIG. 7) and allow the turntable 18-10 to rotate 216° before the microwave energy power relay 7-110 is turned on 18-14. Subsequently, the cook-item 18-20 is heated for 4-seconds during the remaining 144° viz, 4-seconds, of turntable rotation 18-12. As a result, the cook-item (e.g., donut) 18-20 is returned and reparked at the same front-access location 18-5 from which rotation began. This methodology is obviously practicable for other cook-times which do not coincide with an even number of 10-second turntable rotations. For example, a 34-second heat time is accomplished with an initial delay of 6-seconds (e.g., 216°), followed by the remaining 4-seconds (e.g., 144°) of rotation plus an additional three complete 360° circumvolutions which results in landing the cook-item at the front of the cook-chamber 18-5, adjacent the door 18-2, when the cook-time and the turntable rotation are concurrently stopped. As applied to the typical microwave circuitry depicted in FIG. 7. This novel teaching of FIG. 18 is applicable to the circuit configuration of FIG. 7 by modifying the control parameter program 7-134 which enables the control uP 7-140 to command and energize the drive motor relay 7-150 and magnetron power relay 7-112 in the necessary sequence. As a result, an existing previously engineered design for the microwave oven is economically updated by software to include the safety and convenience advantages taught by this invention.

Figure 13:
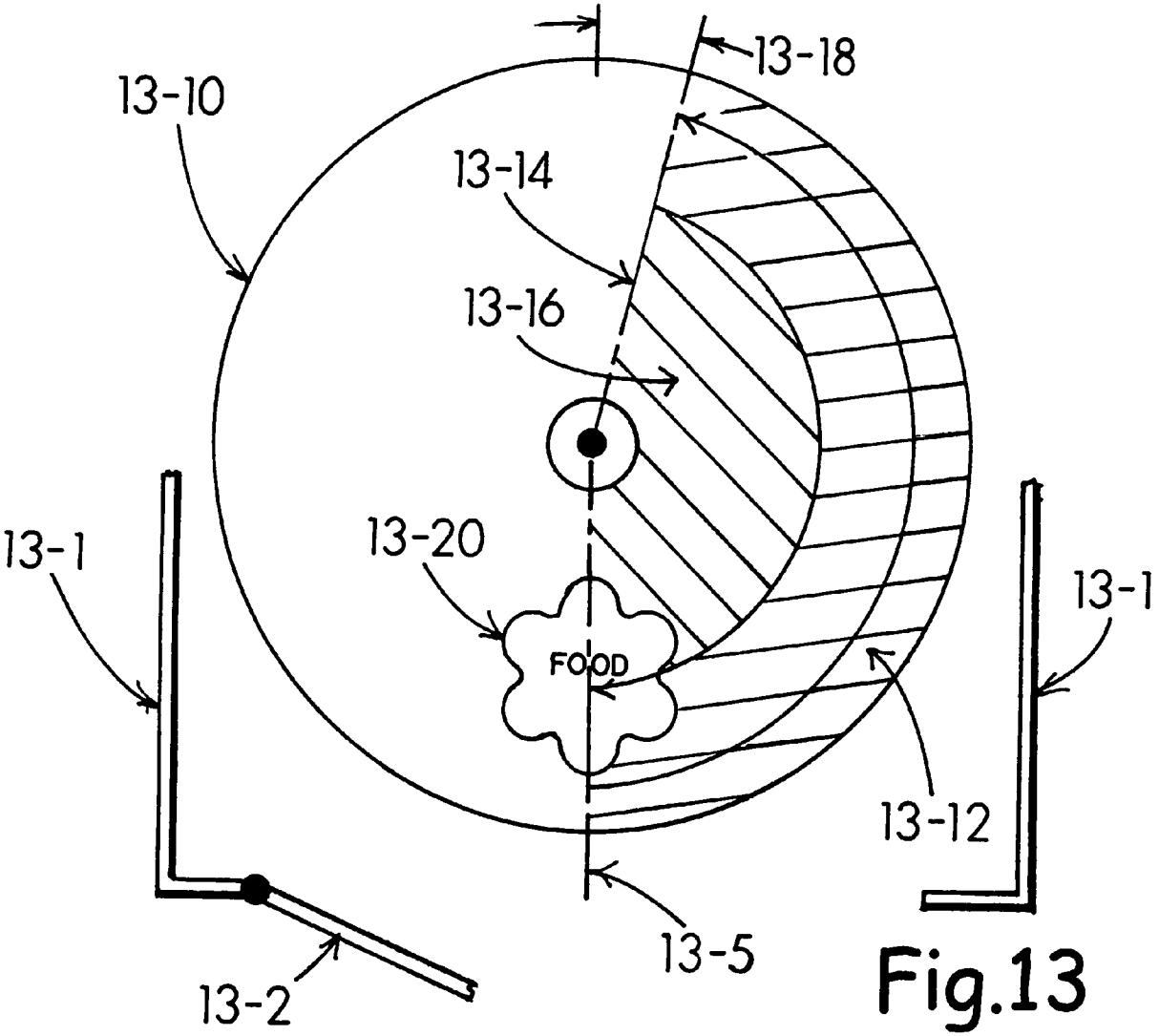
FIG. 13—A cook cycle prematurely interrupted by a user at an inconvenient position approaching a rear-facing 180° situation.

Cooks and other users often interrupt a microwave cook-cycle by opening the door before the cook-time has fully elapsed. Doing so generally leaves the cook-item stranded at a random location on the turntable and, as it so often seems, near the back more often than naught. A rotating turntable 13-10 in FIG. 13 is shown to rotate forward 13-12 ordinarily intent on completing the cook-time $CK_T$ and usually utilizing concurrent cooking and bidirectional turntable rotation synchronized so as to return and repark the cook-item near the oven 13-1 doorway 13-2 at the end of the cook-time $CK_T$. In this showing, the user interrupts the cooking just before the cook-item approaches the backmost portion of the cook-chamber 13-18, for example just 15° shy of 180°, e.g., 165°. If the stopping location is determined to be less than 180°, the heating stops and the turntable rotation reverses and counter-rotates 13-16 the turntable with a returning by the shortest path and reparking the cook-item 13-20 near the initial location 13-5 before fully stopping.

Figure 14:
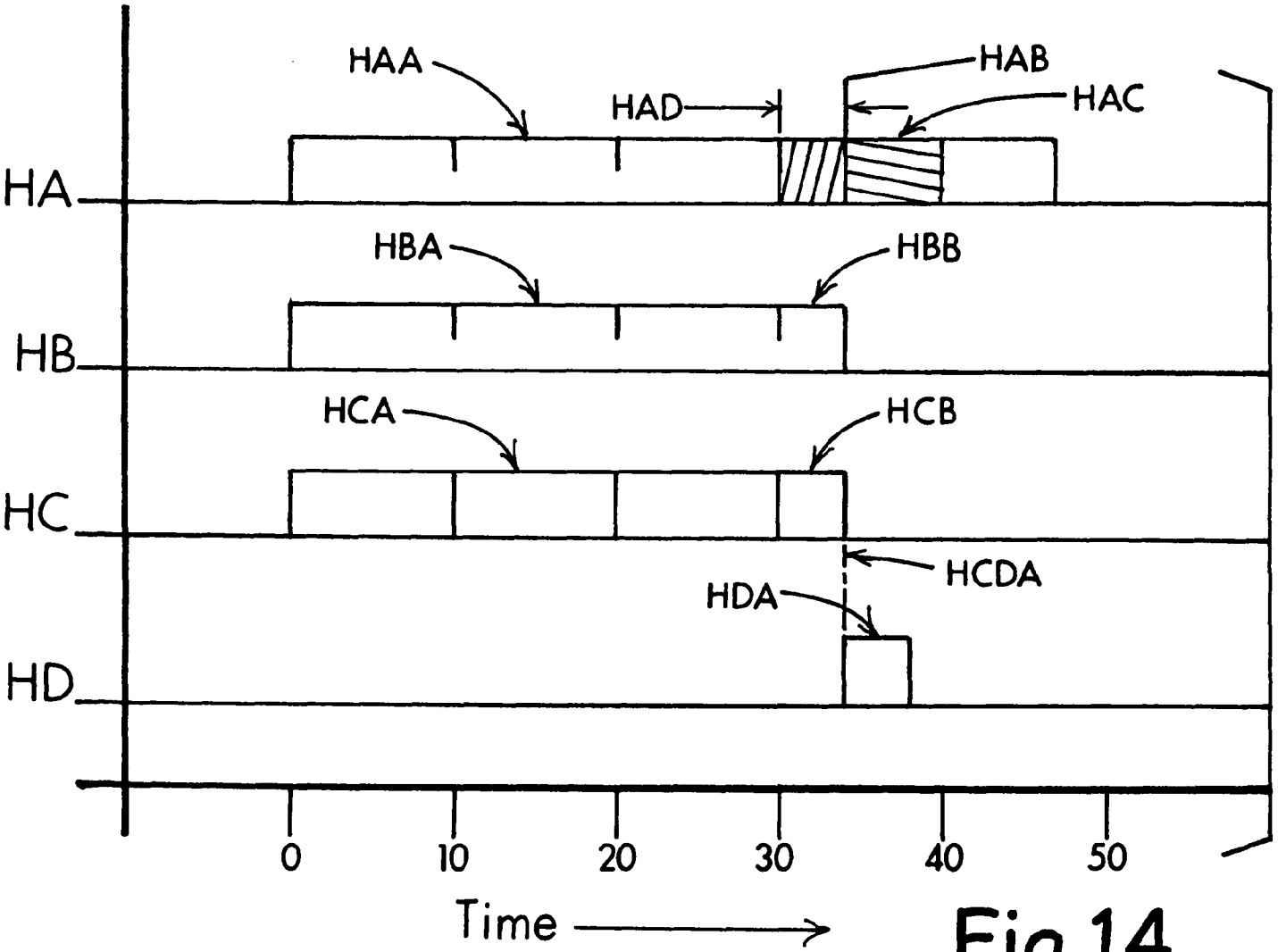
FIG. 14—A timing chart showing the turntable circumvolutory cycle relative with a prematurely interrupted cook-time $CK_T$.

The timing for an extended cook-time application of this early stoppage of cooking shows in FIG. 14 to include several turntable circumvolutions HAA prior to the interruption HAB occurrence and during a shortened period HAD before the current circumvolution reaches 180° displacement from the onset of the shortened period. Meanwhile the turntable's forward drive HBA continues throughout the cook-time $CK_T$ until encountering the interruption HAB that shortens the actual cook-time HBA+HBB. A determination of early (less than 180° rotation angle) of the turntable stoppage initiates HCDA a reversal drive HDA of the turntable for the mirrored duration of the early-interrupted interval HBB. The result is a return and reparking of the cook-item to its initial front-facing location adjacent with the microwave's doorway.

Figure 15:
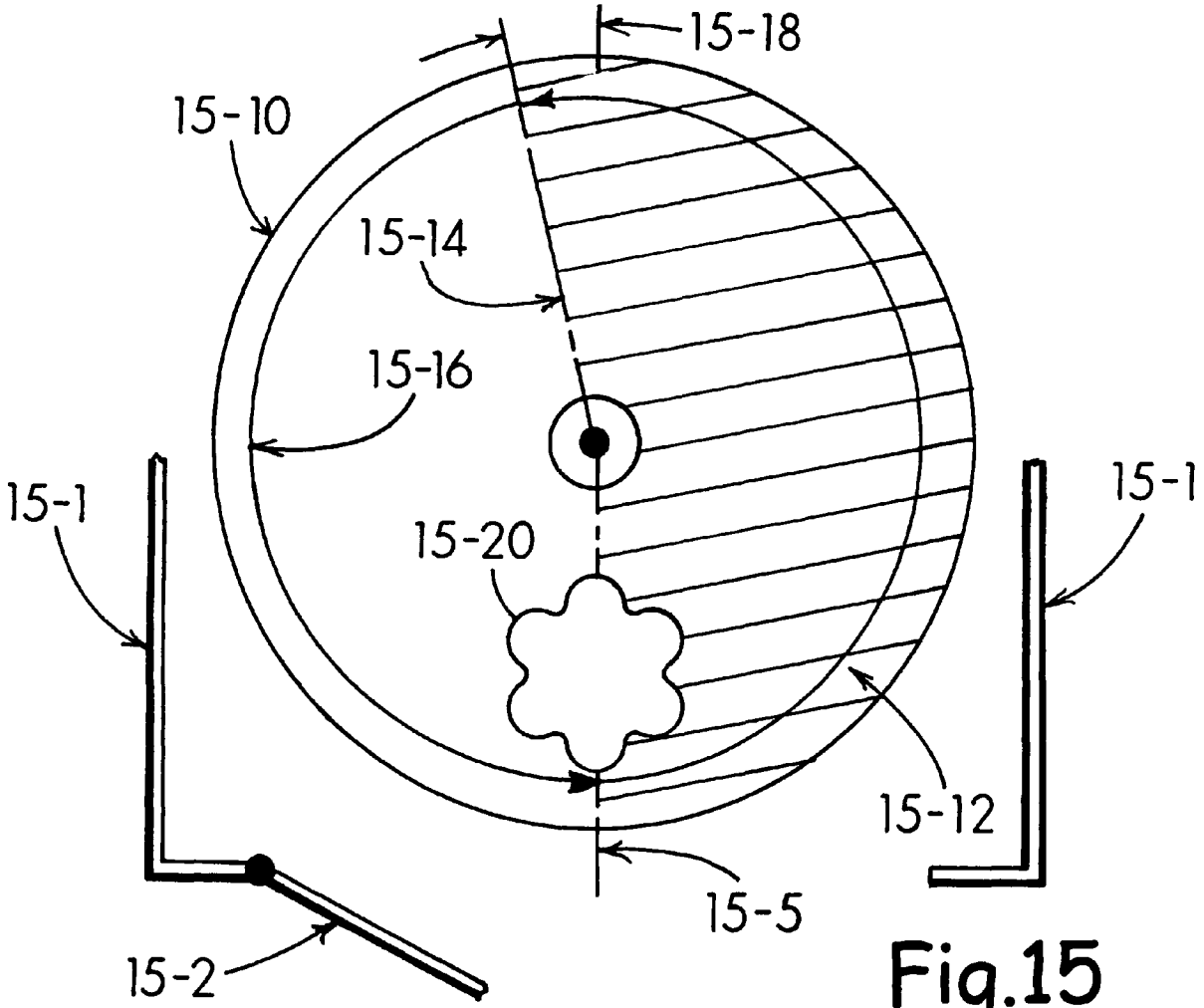
FIG. 15—A cook cycle prematurely interrupted by the user with the turntable just past the rear-facing 180° situation.

In the same context as just mentioned, FIG. 15 shows an early interruption 15-14 of the originally preset cook-time $CK_T$ (e.g., IAA+IAC+IAD) is shortened IABA after the turntable's current circumvolution 15-12 has surpassed 180° 15-18. Upon finding the interruption 15-14 a determination is made that the quickest path for returning the cook-item 15-20 to the initial location 15-5 will occur by continuing the forward turntable rotation 15-16.

Figure 16:
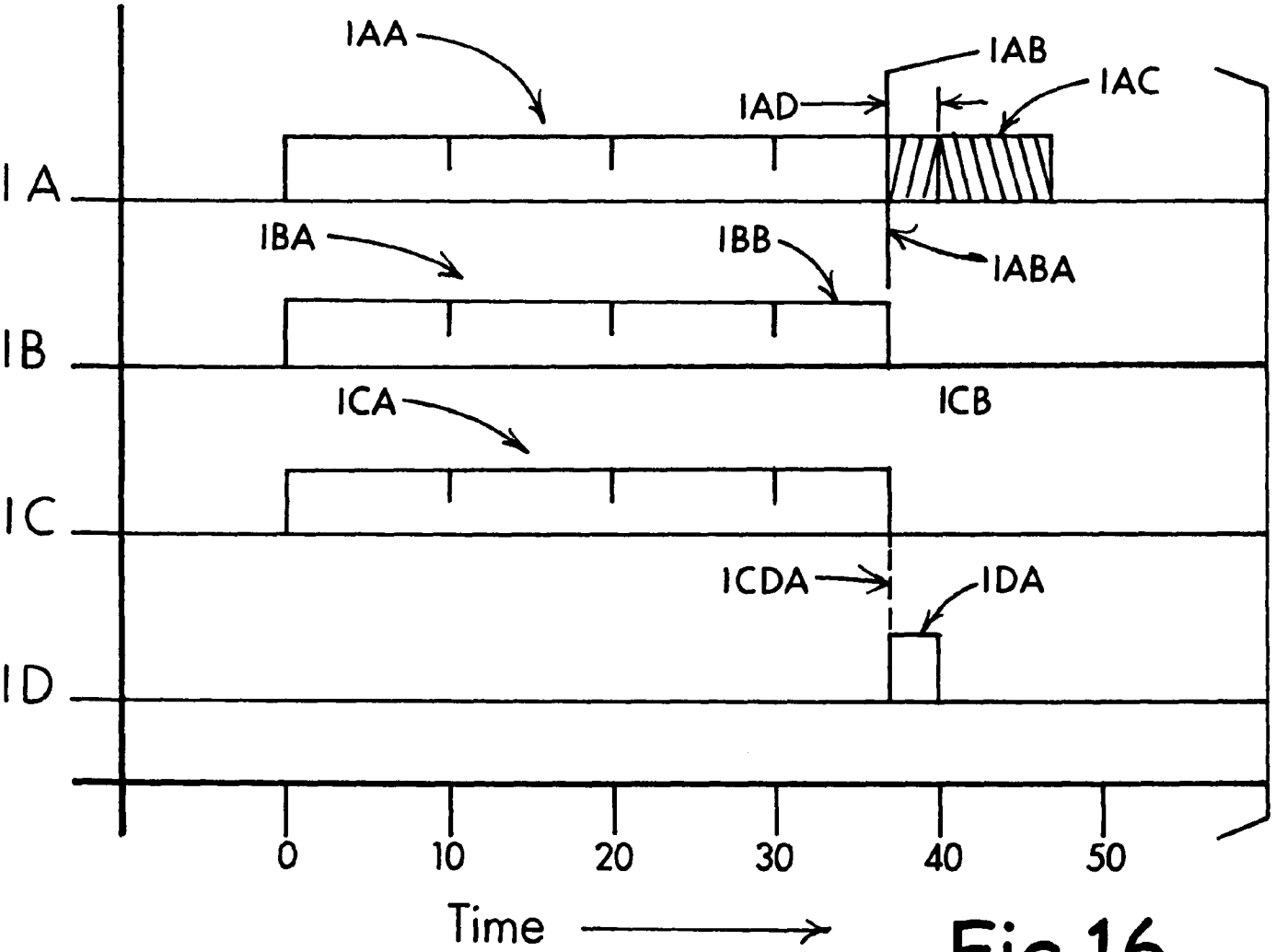
FIG. 16—A timing chart showing the turntable circumvolutory cycle relative with the turntable cook-item location past the rear-facing 180° situation.

In FIG. 16 the original preset cook-time $CK_T$ is represented IAA+IAC+IAD. In this showing, the cook-time $CK_T$ is cut-short IAB past the midpoint (between 30 and 40 on the Time scale) leaving the times IAC and IAD uncompleted. The early termination of the cook-time $CK_T$ is coupled IABA with the microwave heating controller, terminating its operation during the incomplete time increment IBB, past the midpoint. The turntable's rotation ICA also abruptly stops and then it reverses ICDA for a time sufficient to complete the IAD time increment rotating in the reverse direction IDA.

In review, it is the intent of the depictions of FIG. 13 and FIG. 14 to urge the turntable to seek the shortest return path, i.e., backwards, in event of an early (less than 180°) interruption 13-18, HAB of the microwave ovens preset time-cycle $CK_T$ and to reverse the turntable rotation for a sufficient time 13-16, HDA to return the cook-item 13-20 to the original placement location 13-20. Likewise in FIG. 15 and FIG. 16 the invention's intent is to determine that the shortest path home 15-20 subsequent to a greater than 180° interruption IABA is to continue forward and complete the current 360° cycle IDA.

Figure 17:
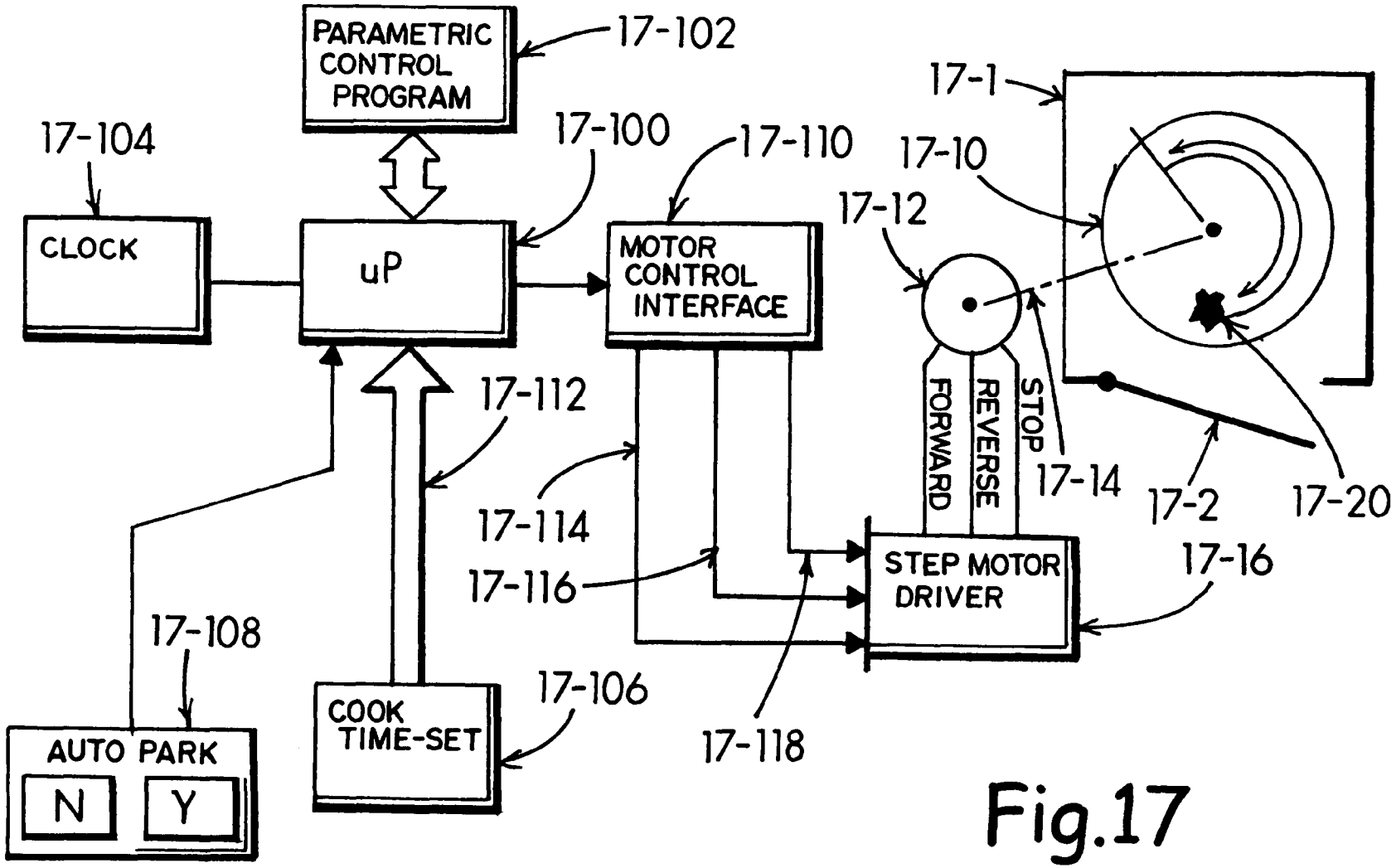
FIG. 17—A functional diagram depicting a stepper-motor based operation of the turntable to provide the bidirectional rotation and including a user selectable "auto-park" facilitation.

An arrangement of elements in FIG. 17 shows advantageous use of a stepper motor drive to facilitate programmed turntable circumvolutory performance. In this rendering a microprocessor 17-100 viz, μP or equivalent, handles the several program 17-102 and user-determined dynamic instructions necessary to manage turntable drive motor control. A clock 17-104 determines the step-pulse rate in conjunction with a cook time set entry provision 17-106. Also included is an "Auto-Park ON/OFF (Y/N)" entry function 17-108. With Auto-Park ON, the turntable rotation is controlled so as to invariably return the cook-item to its initial starting location adjacent with the microwave's front access doorway, in accord with the essence of this invention. On the other hand, with Auto-Park OFF, the turntable stops randomly at the end of a cook-time cycle, just as any ordinary microwave might do. In this showing, the μP 17-100 sends control signals to a motor controller function 17-110. This function delivers "forward" 17-112, "reverse" 17-114 and "stop" 17-116 signals to a step-motor driver 17-16. The step-motor driver couples with and excites a step motor 17-12 linked 17-14 with the turntable 17-10 as depicted in the microwave oven compartment 17-1. In this paradigm arrangement for stepper motor drive, it is known that motors with steps of 1.8°/step are readily available and applicable. Therefore, in order to attain 6-rpm. e.g., 36°/second, the motor's rotation (without intervening gears) must advance 20-steps/second.

PRACTICE CAVEATS

A reasonable and comprehensive effort has been made to explain this invention in a manner which enables a person of modest skill in the art to efficiently duplicate these findings. The utter essence of the invention is to absolutely and remarkably repark a microwave oven's turntable in the same position as it assumed when foodstuff was placed upon the turntable. Moreover, the turntable rotation and the cooking are synchronized to the extent that, as never-before taught, the cooking is completed concurrent with the foodstuff having reached the desired reparking situation adjacent with the front-facing doorway. The endpoint congruency is assured by forward rotating and counter-rotating the turntable substantially the same number of overall degrees concurrent with the cook-time heating cycle thereby assuring a simultaneous end of cook-time and return and reparking of the cook-item in its desired return position. A variant teaching is novel in being attained by retarding a start of the cook-time cycle to usually occur moments after the start of the turntable's rotational cycle to allow the physical circumvolution necessary to achieve a turntable rotational head-start relative to the cook-time. This offset between the two functional cycles allows the end-point concurrence to reliably be achieved. Convenience is honored by permitting immediate removal of the food the instant the cooking ceases and the turntable has reparked.

Other adaptations to obtain this inventions central goal of assured reparking repeatability and congruence between end of rotation and end of cooking power are shown which include mid-cycle pausing of the cook-time and the turntable rotation.

It is fully expect that a skilled artisan will capably develop alternate details for this invention's implementation including a considerable variation regarding physical form details of the microwave oven embodiment form and functional layout as well as the turntable arrangement. More central to this invention is that a savvy engineer may improvise various microprocessor (μP) options, memory configurations, software scripts and firmware arrangements to satisfy any of a variety of obvious end-user and market-dictated operational preferences. These are merely technique variants result from mere applied engineering skill coupled with an ever-increasing plethora of options regarding parts, components, techniques and programming skills which may be utilized to duplicate this invention's contribution to the art-field.

Any attempt by another to circumvent the essence of this invention to attain reaching the cook cycle end-point and the reparking of the turntable's endpoint at the same moment to allow prompt removal of the cooked foodstuff item shall be prudently and thoroughly reviewed with exceptional caution and suspicion. It shall be realized that hindsight cleverness may suggest other physical and technical embodiments exhibiting a difference in operational detail from that which are specifically depicted to become readily apparent to and subsequently tried by others skilled in this art-field. As a consequence to this realization, it is important to understand that other technical hookups, signal processing logic and physical embodiment variations that satisfy this invention's essence are merely natural and obvious extensions of the invention's central teachings. In particular this broadly includes reparking the microwave oven's turntable with the cook-item in the same location at the end of a cook cycle as what its location assumed at the onset of the overall operating cycle. Any circumventive scheme which satisfies this central objective of the invention to synchronize a conclusion, return and reparking of the turntable rotation and completing the cook cycle to simultaneously occur must be found as merely obvious engineering refinements, embodiment practices and operational details that are construed to be irrefutably within the scope of this invention as presently taught and inclusively claimed.

I claim:

1. A microwave oven turntable operating method comprising:

a microwave oven enclosure including a rotatable turntable and an access doorway;

placing a cook-item on the turntable adjacent with the access doorway;

presetting a cook-time $CK_T$;

commencing a circumvolution of the turntable;

enabling microwave cooking for a duration of the preset cook-time $CK_T$; and, determining the turntable's overall circumvolution and subsequent stoppage to effectively return and repark the cook-item adjacent with the access doorway concurrent with a termination of the microwave cooking at the end of the preset cook-time $CK_T$;

concurrently enabling the microwave cooking and the turntable circumvolutory cycle;

forward rotating the turntable for an initial one-half of the preset cook-time, $CK_{T/2}$;

counter-rotating the turntable for a conclusive one-half of the preset cook-time; and, concurrently ending the microwave cooking and stopping the turntable circumvolution with the return and the reparking of the cook-item adjacent with the access doorway.

2. The operating method of claim 1 comprising:

increasing the initial preset cook-time $CK_T$ by submitting a time extension during the duration of the microwave cooking and the turntable circumvolution enablement;

finding one of:

(a) the turntable is forward rotating when the extended time is submitted and adding an initial one-half of the time extension to prolong the time of forward rotation and adding a conclusive one-half of the time extension to a remaining contrarotation time; and, (b) the turntable is counterrotating when the extended time is entered and adding the initial one-half of the time extension to prolong the time of contrarotation followed by adding a subsequent period of forward rotation for the conclusive one-half of the time extension; and, regaining a synchronic relationship between an extent of the total forward angular circumvolution and the contrarotation to achieve the return and reparking of the cook-item adjacent with the access door;

whereby the overall forward rotation interval and overall contrarotation interval are effectively equal, and mutually canceling with an overall angular rotation of the turntable and return of the cook-item adjacent with the access doorway.

3. The operating method of claim 1 comprising:

determining a single 360° circumvolution time period for the turntable;

finding the cook-time $CK_T$ substantially less than the single 360° circumvolution time period;

delaying the start of the microwave cooking and forward rotating the turntable for the duration of the preset cook-time $CK_T$;

starting the microwave cooking and counterrotating the turntable for the duration of the preset cook-time $CK_T$;

concurrently stopping the turntable and the microwave cooking, and, concluding with the turntable return and the reparking of the cook-item adjacent with the access doorway when the microwave cooking terminates.

4. The operating method of claim 1 comprising:

determining a single 360° circumvolution time period for the turntable;

concurrently starting the microwave cooking and the turntable rotation;

finding the cook-time $CK_T$ exceeds the 360° circumvolution time period;

forward rotating the turntable for a floor-integral number of consummated 360° circumvolutions having a total elapsed circumvolution time duration approaching and not exceeding the cook-time $CK_T$;

determining a time extent that the cook-time $CK_T$ surpasses the total elapsed circumvolution time duration;

continuing the turntable rotation past the last complete 360° circumvolution for one-half the determined time extent;

counter-rotating the turntable rotation for a remaining one-half of the determined time extent;

simultaneously stopping the turntable rotation and the microwave cooking concurrent with the end of the cook-time $CK_T$; and, concluding with the turntable return and the reparking of the cook-item adjacent with the access doorway when the microwave cooking stops.

5. The operating method of claim 1 comprising:

reckoning a floor-integral number of complete 360° turntable circumvolutions having a total elapsed time duration approaching and not exceeding the cook-time $CK_T$;

determining a time extent that the cook-time $CK_T$ exceeds the total elapsed time duration for the reckoned floor-integral number of the complete 360° turntable circumvolutions;

forward-rotating the turntable for one-half the determined time extent concurrent with starting the microwave cooking for an initial duration of the cook-time $CK_T$;

counter-rotating the turntable through the reckoned number of complete circumvolutions for a remaining duration of the cook-time $CK_T$ including a conclusive one-half of the determined time extent;

simultaneously stopping the turntable rotation and the microwave cooking concurrent with the end of the cook-time $CK_T$; and, concluding with the turntable return and the reparking of the cook-item adjacent with the access doorway when the microwave cooking stops.

6. The operating method of claim 5 comprising:

entering a change in the preset cook-time $CK_T$ subsequent to the start of the turntable rotation and microwave cooking;

recalculating the overall parametric profile of the turntable's bidirectional circumvolution and subsequent rotation stoppage relative with the change in the cook-time CKr; and, regaining synchronization between the turntable circumvolution and the change in the cook-time $CK_T$ to urge the turntable to return and repark the cook-item adjacent with the access doorway concurrent with the ending of the changed cook-time $CK_T$.

7. The operating method of claim 1 comprising:

presetting a program for controlling of the microwave cooking to include at least one time pause during the cook-time $CK_T$;

concurrently stopping the turntable rotation, stopping the microwave cooking and interrupt an elapse of the cook-time $CK_T$ for a duration of the pause time;

resuming the turntable rotation, the microwave cooking and a continuation of timing a remaining duration of the cook-time $CK_T$; and, simultaneously ending the cook-time $CK_T$ and stopping the turntable rotation including the return and reparking of the cook-item adjacent with the access doorway.

8. The operating method of claim 1 comprising:

driving the turntable with a stepping-motor;

defining a number of step-counts for a complete 360° turntable circumvolution; and, calculating the stepping-motor drive parameters of steps-per-second and overall number of steps relative with the preset cook-time $CK_T$ duration to urge the bidirectional circumvolution of the turntable and achieve at least a concurrency of completing the cook-time $CK_T$ and stopping the turntable with the return and reparking of the cook-item adjacent with the access doorway.

9. The operating method of claim 1 comprising:

finding that a premature stoppage of the cook-time CKr causes the turntable to randomly stop leaving the cook-item placement at an errant location relative with the access doorway;

finding the turntable stopping with the cook-item placement equal-to or greater-than 180° from the access doorway in the current direction of turntable circumvolution and maintaining the current direction until the cook-item placement is returned and reparked adjacent with the access doorway; and otherwise; and, finding the turntable stopping with the cook-item placement less-than 180° from the access doorway in the current direction of turntable circumvolution and reversing and counter-rotating the turntable until the cook-item placement is returned and reparked adjacent with the access doorway;

whereby an early interruption of the cook-time $CK_T$ enables the turntable to complete the bidirectional circumvolution cycle and attain a return and reparking of the cook-item adjacent with the access doorway in the least amount of time.

10. A microwave oven turntable operating method comprising:

configurating a microwave oven enclosure to include a rotatable turntable for receiving placement of a cook-item adjacent with an access portal;

presetting a preferred microwave cooking time $CK_T$;

commencing a circumvolution of the turntable;

starting a microwave-heating source for a duration of the cook-time $CK_T$;

determining a conclusion of the cooking time $CK_T$; and, concurrently stopping the microwave heating source and the turntable circumvolution with the cook-item reparked adjacent with the access portal;

forward rotating the turntable for an initial one-half the preferred microwave cook-time, $CK_{T/2}$;

counterrotating the turntable for a conclusive one-half of the preferred microwave cook-time $CK_T$; and, the stoppage of the turntable returns and reparks the cook-item adjacent with the access portal;

whereby the turn-table and the cook-item forward-rotate for one-half the cook-time and subsequently counter-rotates for a remaining one-half of the cook-time to return and repark the cook-item adjacent with the access portal concurrent with a completion of the cook-time $CK_T$.

11. The turntable operating method of claim 10 comprising:

finding a single 360° circumvolution time period for the turntable exceeds the preferred cook-time $CK_T$;

forward rotating the turntable for an interval equivalent with the preferred cook-time $CK_T$; the starting of the microwave-heating source and counterrotating the turntable for the duration of the preferred cook-time $CK_T$; and, concurrently stopping the counterrotating turntable and the microwave-heating source;

whereby the turntable is initially forward rotating with the microwave heating source disabled and subsequently counterrotating with microwave heating source enabled resulting in the return and reparking of the cook-item adjacent with the access portal concurrent with the end of the cook-time $CK_T$.

12. The turntable operating method of claim 10 comprising:

reckoning a number of completable 360° turntable circumvolutions having a total elapsed time duration approaching and not exceeding the cook-time $CK_T$;

determining an excedent time extent by which the cook-time $CK_T$ surpasses the total elapsed time duration for the reckoned number of turntable circumvolutions;

forward-rotating the turntable for an initial one-half the excedent time extent concurrent with enabling the microwave-heating source for an initial duration of the cook-time $CK_T$;

counterrotating the turntable through the reckoned number of the completable circumvolutions for a remaining duration of the cook-time $CK_T$ including a concluding one-half of the excedent time extent; and, simultaneously stopping the turntable rotation and the microwave-heating source concurrent with the end of the cook-time $CK_T$ including the return and the reparking of the cook-item adjacent with the access portal.

13. The turntable operating method of claim 10 comprising:

reckoning a number of completable 360° turntable circumvolutions having a total elapsed time duration approaching and not exceeding the cook-time $CK_T$;

determining an excedent time extent that the cook-time $CK_T$ surpasses the total elapsed time duration for the reckoned number of the completable turntable circumvolutions;

delaying start of the microwave-heating source while forward-rotating the turntable for a duration of the excedent time extent;

starting a cook-cycle for a duration of the preferred cook-time $CK_T$;

counterrotating the turntable through the reckoned number of the completable circumvolutions for the duration of the cook-time including the determined excedent time extent; and, simultaneously stopping the turntable rotation and the microwave-heating source concurrent with the end of the cook-time $CK_T$ including the return and the reparking of the cook-item adjacent with the access portal.

14. The turntable operating method of claim 10 comprising:

reckoning a number of completable 360° turntable circumvolutions having a total elapsed time duration approaching and not exceeding the cook-time $CK_T$;

determining an excedent time extent $ET_A$ that the cook-time surpasses the total elapsed time duration for the reckoned number of turntable circumvolutions;

forward rotating the turntable through the reckoned number of the completable circumvolutions plus one-half the excedent time extent $ET_{A/2}$ concurrent with enabling the microwave-heating source for an initial duration of the cook-time $CK_T$;

counterrotating the turntable for a remaining duration of the cook-time $CK_T$ including the conclusive one-half of the excedent time extent $ET_A$; and, simultaneously stopping the turntable rotation and the microwave-heating source concurrent with the end of the cook-time $CK_T$; whereby the turntable returns and reparks the cook-item adjacent with the access portal.

15. The turntable operating method of claim 10 comprising:

recalculating overall parameters of turntable's bidirectional circumvolution relative with a change of the cook-time $CK_T$ entered during an elapsing cook-cycle; and, reestablishing a synchronization of dynamic parameters for the turntable circumvolution and the change in the cook-time $CK_T$ required to assure that the turntable returns and reparks the cook-item adjacent with the front access portal concurrent with an ending of the changed cook-time $CK_T$ and the stoppage of the microwave-heating source.

16. The turntable operating method of claim 10 comprising:

driving the turntable with a stepper motor;

defining a number of step-pulses for a complete 360° turntable circumrotation;

calculating the turntable rotational parameters relative with the preset cook-time $CK_T$ as a proportional number of step-pulse signals for driving the stepper motor and achieve the urging of the circumvolution, return and reparking of the turntable; and, determining a step-pulse rate for the step-pulse signals relative with the preset cook-time $CK_T$ to enable the return and reparking of the turntable adjacent with the front-access portal concurrent with the microwave heating source stoppage.

17. A microwave oven turntable operating method comprising:

encasing a microwave cooking chamber to include access through a front-facing doorway;

disposing a turntable in the microwave cooking chamber;

initially placing a cook-item on the turntable adjacent with the front-facing access doorway;

selecting a preferred cook-time $CK_T$;

supplying microwave heating energy to the cooking chamber for the duration of the preferred cook-time $CK_T$;

circumrotating the turntable about a vertical axis for at least the duration of the preferred cook-time $CK_T$; and, reparking the turntable with the cook-item adjacent with the front-facing access doorway concurrent with a completion of the preferred cook-time $CK_T$;

configuring a stepping motor in combination with a drive-signal source to produce the circumrotation of the turntable concurrent with the preferred cook-time $CK_T$;

programming the drive-signal source to deliver a predetermined number of step pulses combined with a step-pulse per second rate sufficient to produce at least one of:

(1) a non-zero integer number of 360-degree turntable circumrotation in a first direction; and (2) an extent of turntable circumrotation in the first direction combined with an equal extent of counter-rotation in a second direction, to assure a return of the cook-item to be adjacent with the front-access doorway;

whereby the turntable speed and direction of circumrotation are determined relative with an overall duration of the preferred cook-time $CK_T$ to achieve a return of the cook-item adjacent with the front-facing doorway when the cook-time $CK_T$ duration completes.

* * * * *